US006424937B1

(12) United States Patent
Kato et al.

(10) Patent No.: US 6,424,937 B1
(45) **Date of Patent: *Jul. 23, 2002**

(54) FUNDAMENTAL FREQUENCY PATTERN GENERATOR, METHOD AND PROGRAM

(75) Inventors: Yumiko Kato, Neyagawa; Kenji Matsui, Ikoma; Takahiro Kamai, Kyoto; Noriyo Hara, Neyagawa, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/201,298

(22) Filed: Nov. 30, 1998

(30) Foreign Application Priority Data

Nov. 28, 1997 (JP) ..... 9-327777
Jun. 17, 1998 (JP) ..... 10-169624
Nov. 24, 1998 (JP) ..... 10-333212

(51) Int. Cl.[7] ..... G10L 11/04; G10L 19/14
(52) U.S. Cl. ..... 704/207; 704/205
(58) Field of Search ..... 704/200–207, 704/251–258

(56) References Cited

U.S. PATENT DOCUMENTS 5,220,629 A * 6/1993 Kosaka et al. ..... 704/260
5,463,713 A * 10/1995 Hasegawa ..... 704/260
5,611,018 A * 3/1997 Tanaka et al. ..... 704/267
5,615,300 A * 3/1997 Hara et al. ..... 704/260
5,758,320 A * 5/1998 Asano ..... 704/268
5,845,047 A * 12/1998 Fukada et al. ..... 704/268
5,903,867 A * 5/1999 Watari et al. ..... 704/270

FOREIGN PATENT DOCUMENTS

JP 5-88690 4/1993 ..... G10L/3/00
JP 5-173590 7/1993 ..... G10L/3/02
JP 08-123469 * 10/1994 ..... G10L/3/00

OTHER PUBLICATIONS

"Modeling The Dynamic Characteristics of Voice Fundamental Frequency With Applications To Analysis And Synthesis of Intonation", H. Fujisaki et al. 1982, pp. 57–70.

* cited by examiner

*Primary Examiner*—Richemond Dorvil
*Assistant Examiner*—Daniel A. Nolan
(74) *Attorney, Agent, or Firm*—Ratner & Prestia

(57) ABSTRACT

According to this fundamental frequency generating method, a fundamental frequency pattern is set from a data base of a fundamental frequency pattern of each accent phrase standardized by the phoneme time length or the time length of the vowel and the vowel corresponding portion, and when the corresponding fundamental frequency pattern is not stored in the data base, the fundamental frequency pattern is generated by interpolating the interval between points serving as the references of the fundamental frequency pattern. With this method, a fundamental frequency pattern having higher naturalness than with conventional methods can be generated.

97 Claims, 20 Drawing Sheets

(A) FUNDAMENTAL FREQUENCY PATTERN OF ℓ-MORA m TYPE
(OBTAINED FROM PHONEME TIME LENGTH STANDARDIZED FUNDAMENTAL FREQUENCY DATA BASE 351)

(B) GENERATED FUNDAMENTAL FREQUENCY PATTERN OF n- MORA m TYPE (A) FUNDAMENTAL FREQUENCY PATTERN OF ℓ-MORA j TYPE (OBTAINED FROM PHONEME TIME LENGTH STANDARDIZED FUNDAMENTAL FREQUENCY DATA BASE 351)

(B) GENERATED FUNDAMENTAL FREQUENCY PATTERN OF n-MORA m TYPE (A) FUNDAMENTAL FREQUENCY PATTERN OF ℓ-MORA j TYPE (OBTAINED FROM PHONEME TIME LENGTH STANDARDIZED FUNDAMENTAL FREQUENCY DATA BASE 351)

(B) GENERATED FUNDAMENTAL FREQUENCY PATTERN OF n- MORA m TYPE (A) FUNDAMENTAL FREQUENCY PATTERN OF ℓ-MORA FLAT TYPE (OBTAINED FROM PHONEME TIME LENGTH STANDARDIZED FUNDAMENTAL FREQUENCY DATA BASE 351)

(B) GENERATED FUNDAMENTAL FREQUENCY PATTERN OF n- MORA FLAT TYPE

FUNDAMENTAL FREQUENCY PATTERN GENERATOR, METHOD AND PROGRAM

BACKGROUND OF THE INVENTION

1. Field of the Invention

The present invention relates to a fundamental frequency pattern generating method used in speech synthesis.

2. Description of the Related Art

A conventional fundamental frequency pattern generating method is such that, paying attention to the accent type, the fundamental frequency pattern is decided by the critical damping quadratic linear system on the logarithmic frequency axis with the start point or the vowel start point of the mora concerned as the reference like Japanese Laid-open Patent Application Hei5-173590. Another conventional method is such that the fundamental frequency of each mora is decided with attention paid to the accent type, the kind of the phonological segment and the mora position of the word or the phrase like Japanese Laid-open Patent Application Hei5-88690.

According to these methods, however, it is impossible to accurately decide variation in fundamental frequency in a mora, or distortion is caused on the real time axis due to the difference in time length among morae, so that the rhythm typified by the accent becomes unnatural.

SUMMARY OF THE INVENTION

The present invention is intended to solve the above-mentioned problem of the conventional fundamental speech frequency pattern generating methods.

An aspect of the present invention is a fundamental frequency pattern generating method for generating a fundamental frequency of an accent phrase, wherein a fundamental frequency data base is referred to that stores (1) a fundamental frequency pattern obtained by standardizing a fundamental frequency pattern of at least one of the following phonological segments by a time length of the phonological segment: a first phonological segment of the accent phrase; a phonological segment where the fundamental frequency takes a maximum value; a phonological segment of an accent nucleus and a phonological segment next to the accent nucleus; and one phonological segment at an end, or (2) a fundamental frequency pattern obtained by standardizing a fundamental frequency pattern of a phoneme included in at least one of said phonological segments by a time length of the phoneme, wherein (3) fundamental frequency patterns of all or part of the following phonological segments: the first phonological segment of the accent phrase for which the fundamental frequency is to be generated; the phonological segment where the fundamental frequency takes the maximum value in the accent phrase; the phonological segment of the accent nucleus and the phonological segment next to the accent nucleus in the accent phrase; and the phonological segment of the end of the accent phrase, or (4) a fundamental frequency pattern of each phoneme included in said phonological segments is set, and wherein a fundamental frequency pattern between the phonological segments or between the phonemes which fundamental frequency pattern has not been set in a stage of the fundamental frequency pattern setting is interpolated by a function on a real time axis.

Another aspect of the present invention is a fundamental frequency pattern generating method for generating a fundamental frequency of an accent phrase, wherein all or part of a rise reference point of the accent phrase for which the fundamental frequency is to be generated, a fall reference point generating an accent, an accent phrase end reference point deciding fundamental frequency patterns of a plurality of phonological segments including any of one phonological segment at an end of the accent phrase, and a word end reference point generating a fundamental frequency pattern of a word end are set on a time axis standardized by a time length of a phoneme included in each phonological segment, wherein a fundamental frequency data base is referred to that stores, of fundamental frequencies extracted from fundamental frequency patterns obtained by standardizing the fundamental frequency patterns of the phonemes included in the phonological segments by time lengths of the phonemes, a fundamental frequency pattern of at least one of the rise reference point of the accent phrase, the fall reference point, the accent phrase end reference point and the word end reference point, wherein a fundamental frequency at the set reference point is set with reference to the fundamental frequency data base, and wherein a fundamental frequency between the reference points which fundamental frequency has not been set in a stage of the fundamental frequency setting is interpolated by a function on a real time axis or by a fundamental frequency pattern plotted on the real time axis.

Still another aspect of the present invention is a fundamental frequency pattern generating method for generating a fundamental frequency of an accent phrase, wherein a fundamental frequency data base is referred to that stores a fundamental frequency pattern obtained by standardizing a fundamental frequency pattern corresponding to a vowel portion included in at least one of the following phonological segments by a time length of the vowel included in the phonological segment: a first phonological segment of the accent phrase; a phonological segment where the fundamental frequency takes a maximum value; a phonological segment of an accent nucleus and a phonological segment next to the accent nucleus; and one phonological segment at an end or a plurality of phonological segments which are four or less phonological segments from the end, wherein in all or part of the following phonological segments: the first phonological segment of the accent phrase for which the fundamental frequency is to be generated; the phonological segment where the fundamental frequency is the maximum value in the accent phrase; the phonological segment of the accent nucleus and the phonological segment next to the accent nucleus in the accent phrase; and the phonological segment of the end of the accent phrase, a fundamental frequency pattern for each vowel included in the phonological segments is set, and wherein a fundamental frequency between the phonological segments for which the fundamental frequency pattern setting is not performed is interpolated by a function on a real time axis.

Still yet another aspect of the present invention is a fundamental frequency pattern generating method for generating a fundamental frequency of an accent phrase, wherein all or part of a rise reference point of the accent phrase for which the fundamental frequency is to be generated, a fall reference point generating an accent, an accent phrase end reference point deciding a fundamental frequency pattern of an end of the accent phrase, and a word end reference point generating a fundamental frequency pattern of a word end are set on a time axis standardized by a time length of a phoneme included in each phonological segment, wherein a fundamental frequency data base is referred to that stores, of fundamental frequencies extracted from fundamental frequency patterns obtained by standardizing fundamental frequency patterns of vowels included in the phonological segments by time lengths of the vowels, a fundamental frequency of at least one of the rise reference point of the accent phrase, the fall reference point, the accent phrase end reference point and the word end reference point, wherein a fundamental frequency at the set reference point is set with reference to the fundamental frequency data base, and wherein a fundamental frequency between the reference points for which the fundamental frequency setting is not performed is interpolated by a function on a real time axis or by a fundamental frequency pattern plotted on the real time axis.

A further aspect of the present invention is a fundamental frequency pattern generating method for generating a fundamental frequency of an accent phrase, wherein a fundamental frequency pattern of each accent phrase is set with reference to a fundamental frequency data base that stores a fundamental frequency pattern standardized by a time length of each phoneme included in a phonological segment classified according to one or both of the number of phonological segments and an accent position, and wherein a value corresponding to a phoneme or a phonological segment string for which the fundamental frequency is to be generated is obtained from a microprosody data base that stores a difference between a fundamental frequency of each phonological segment or each phoneme string standardized by a time length of the phoneme and said fundamental frequency pattern which difference is classified according to a phonological segment or a phoneme string, and the corresponding value is added to the set fundamental frequency or subtracted from the set fundamental frequency to thereby generate the fundamental frequency of the accent phrase.

An aspect of the present invention is a fundamental frequency pattern generating method for generating a fundamental frequency pattern of an accent phrase by use of a fundamental frequency data base storing a fundamental frequency pattern classified according to the number of phonological segments and an accent position, wherein when a fundamental frequency pattern corresponding to the number of phonological segments and an accent pattern of the accent phrase for which the fundamental frequency pattern is to be generated is not stored in the fundamental frequency data base and an accent position of the accent phrase for which the fundamental frequency is to be generated is the same or before a phonological segment position next to a phonological segment position including a peak of the fundamental frequency stored in the fundamental frequency data base, (1) the fundamental frequency pattern stored in the fundamental frequency data base is used which has an accent position the same as the accent position of the accent phrase for which the fundamental frequency pattern is to be generated, said fundamental frequency pattern stored in the fundamental frequency data base corresponding to the number of phonological segments closest to the number of phonological segments of the accent phrase for which the fundamental frequency pattern is to be generated, (2) a fundamental frequency pattern from a first phonological segment to a phonological segment next to an accent nucleus is generated by applying a fundamental frequency from a first phonological segment to a phonological segment next to an accent nucleus of a fundamental frequency pattern stored in the fundamental frequency data base, (3) a fundamental frequency from a second phonological segment from the accent nucleus to a phonological segment immediately before an end of the accent phrase including predetermined four or less number of phonological segments is generated by performing interpolation by (a) fundamental frequencies of the second phonological segment from the accent nucleus and the end of the accent phrase or (b) fundamental frequencies of the phonological segment next to the accent nucleus and the end of the accent phrase or (c) fundamental frequencies of the second phonological segment from the accent nucleus and the phonological segment immediately before the end of the accent phrase or (d) fundamental frequencies of the phonological segment next to the accent nucleus and the phonological segment immediately before the end of the accent phrase of the fundamental frequency pattern stored in the fundamental frequency data base, and (4) a fundamental frequency of the end of the accent phrase for which the fundamental frequency pattern is to be generated is generated by applying a fundamental frequency of the end of the accent phrase of the fundamental frequency pattern stored in the fundamental frequency data base.

Another aspect of the present invention is a fundamental frequency pattern generating method for generating a fundamental frequency pattern of an accent phrase by use of a fundamental frequency data base storing a fundamental frequency pattern classified according to the number of phonological segments and an accent position, wherein when a fundamental frequency pattern corresponding to the number of phonological segments and an accent pattern of the accent phrase for which the fundamental frequency pattern is to be generated is not stored in the fundamental frequency data base and an accent position of the accent phrase for which the fundamental frequency pattern is to be generated is after a phonological segment position next to a phonological segment position including a peak of the fundamental frequency stored in the fundamental frequency data base and before an end of the predetermined accent phrase, (1) a fundamental frequency pattern stored in the fundamental frequency data base is used which has an accent nucleus at a second phonological segment from the peak of the fundamental frequency stored in the fundamental frequency data base or at a phonological segment thereafter and before the end of the accent phrase, said fundamental frequency pattern stored in the fundamental frequency data base corresponding to the number of phonological segments closest to the number of the phonological segments of the accent phrase for which the fundamental frequency is to be generated, (2) a fundamental frequency pattern from a first phonological segment of the accent phrase for which the fundamental frequency is to be generated to the phonological segment including the peak of the fundamental frequency is generated by applying a fundamental frequency from a first phonological segment of the fundamental frequency pattern stored in the fundamental frequency data base to the phonological segment including the peak of the fundamental frequency, (3) a fundamental frequency from the phonological segment next to the phonological segment including the peak of the fundamental frequency to a phonological segment immediately before the accent nucleus is generated by performing interpolation by (a) fundamental frequencies of the phonological segment including the. peak of the fundamental frequency and a phonological segment including the accent nucleus or (b) fundamental frequencies of the phonological segment including the peak of the fundamental frequency and the fundamental frequency immediately before the phonological segment including the accent nucleus or (c) fundamental frequencies of the phonological segment next to the phonological segment including the peak of the fundamental frequency and the phonological segment including the accent nucleus or (d) fundamental frequencies of the phonological segment next to the phonological segment including the peak of the fundamental frequency and the phonological segment immediately before the phonological segment including the accent nucleus of the fundamental frequency pattern stored in the fundamental frequency data base, (4) fundamental frequencies of the phonological segment including the accent nucleus of the accent phrase for which the fundamental frequency is to be generated and a phonological segment immediately thereafter are generated by applying fundamental frequencies of the phonological segment including the accent nucleus and a phonological segment immediately thereafter of the fundamental frequency pattern stored in the fundamental frequency data base, (5) a fundamental frequency from a second phonological segment from the accent nucleus to a phonological segment immediately before an end of the accent phrase including predetermined four or less number of phonological segments is generated by performing interpolation by (a) fundamental frequencies of the second phonological segment from the accent nucleus and the end of the accent phrase or (b) fundamental frequencies of the phonological segment next to the accent nucleus and the end of the accent phrase or (c) fundamental frequencies of the second phonological segment from the accent nucleus and the phonological segment immediately before the end of the accent phrase or (d) fundamental frequencies of the phonological segment next to the accent nucleus and the phonological segment immediately before the end of the accent phrase of the fundamental frequency pattern stored in the fundamental frequency data base, and (6) a fundamental frequency pattern of the end of the accent phrase for which the fundamental frequency is to be generated is generated by applying a fundamental frequency of the phonological segment of the end of the accent phrase of the fundamental frequency pattern stored in the fundamental frequency data base.

Still another aspect of the present invention is a fundamental frequency pattern generating method for generating a fundamental frequency pattern of an accent phrase by use of a fundamental frequency data base storing a fundamental frequency pattern classified according to the number of phonological segments and an accent position, wherein when a fundamental frequency pattern corresponding to the number of phonological segments and an accent pattern of the accent phrase for which the fundamental frequency pattern is to be generated is not stored in the fundamental frequency data base and an accent position of the accent phrase for which the fundamental frequency is to be generated is included in a phonological segment of an end of the accent phrase, (1) the fundamental frequency pattern stored in the fundamental frequency data base is used in which the accent position in the end of the accent phrase of the accent phrase for which the fundamental frequency is to be generated and the accent position in the end of the accent phrase are the same, said fundamental frequency pattern stored in the fundamental frequency data base corresponding to the number of phonological segments closest to the number of phonological segments of the accent phrase for which the fundamental frequency is to be generated, (2) a fundamental frequency pattern from a first phonological segment of the accent phrase for which the fundamental frequency is to be generated to a phonological segment including a peak of the fundamental frequency is generated by applying a fundamental frequency from a first phonological segment of the fundamental frequency pattern stored in the fundamental frequency data base to a phonological segment including a peak of the fundamental frequency, (3) a fundamental frequency from a phonological segment next to the phonological segment including the peak of the fundamental frequency to a phonological segment immediately before an accent nucleus is generated by performing interpolation by (a) fundamental frequencies of the phonological segment including the peak of the fundamental frequency and a phonological segment including the accent nucleus or (b) fundamental frequencies of the phonological segment including the peak of the fundamental frequency and the phonological segment immediately before the phonological segment including the accent nucleus or (c) fundamental frequencies of a phonological segment next to the phonological segment including the peak of the fundamental frequency and the phonological segment including the accent nucleus or (d) fundamental frequencies of the phonological segment next to the phonological segment including the peak of the fundamental frequency and the phonological segment immediately before the phonological segment including the accent nucleus of the fundamental frequency pattern stored in the fundamental frequency data base, and (4) a fundamental frequency from a phonological segment including an accent nucleus of the accent phrase for which the fundamental frequency is to be generated to a last phonological segment of the accent phrase is generated by applying a fundamental frequency from the phonological segment including the accent nucleus of the fundamental frequency pattern stored in the fundamental data base to a last phonological segment of the accent phrase.

Still yet another aspect of the present invention is a fundamental frequency pattern generating method for generating a fundamental frequency pattern of an accent phrase by use of a fundamental frequency data base storing a fundamental frequency pattern classified according to the number of phonological segments and an accent position, wherein when a fundamental frequency pattern corresponding to the number of phonological segments and an accent pattern of the accent phrase for which the fundamental frequency pattern is to be generated is not stored in the fundamental frequency data base and an accent type of the accent phrase for which the fundamental frequency is to be generated is a flat type, (1) a fundamental frequency pattern stored in the fundamental frequency data base is used which corresponds to the number of phonological segments closest to the number of phonological segments of the accent phrase of the flat type for which the fundamental frequency is to be generated, (2) a fundamental frequency pattern from a first phonological segment to a phonological segment including a peak of a fundamental frequency is generated by applying a fundamental frequency from a first phonological segment of the fundamental frequency pattern stored in the fundamental frequency data base to a phonological segment including a peak of the fundamental frequency, (3) a fundamental frequency from a phonological segment next to the phonological segment including the peak of the fundamental frequency to a phonological segment of an end of the accent phrase or immediately before a last phonological segment is generated by performing interpolation by (a) fundamental frequencies of the phonological segment including the peak of the fundamental frequency and the end of the accent phrase or the last phonological segment or (b) fundamental frequencies of the phonological segment including the peak of the fundamental frequency and the phonological segment of the end of the accent phrase or immediately before the last phonological segment or (c) fundamental frequencies of the phonological segment next to the phonological segment including the peak of the fundamental frequency and the end of the accent phrase or the last phonological segment or (d) fundamental frequencies of the phonological segment next to the phonological segment including the peak of the fundamental frequency and the phonological segment of the end of the accent phrase or immediately before the last phonological segment of the fundamental frequency pattern stored in the fundamental frequency data base, and (4) a fundamental frequency pattern of an accent phrase end or a last phonological segment of the accent phrase for which the fundamental frequency is to be generated is generated by applying a fundamental frequency of the phonological segment of the end of the accent phrase or the last phonological segment of the fundamental frequency pattern stored in the fundamental frequency data base.

A further aspect of the present invention is a fundamental frequency pattern generating method using a fundamental frequency data base storing a fundamental frequency pattern of an accent phrase, said fundamental frequency pattern being classified according to a position of the accent phrase in a sentence phrase and whether the accent phrase is situated at an end of a sentence or not.

An aspect of the present invention is a fundamental frequency pattern generating method using a fundamental frequency data base that stores a fundamental frequency pattern of an accent phrase, and using a variation data base that stores a fundamental frequency pattern variation amount for changing one or a plurality of the following characteristics: a start point; a peak; a minimum value; an accent nucleus; an accent fall; an accent phrase end; an end point; and a dynamic range of the fundamental frequency pattern stored in the fundamental frequency data base according to a position, in a sentence phrase, of the accent phrase for which the fundamental frequency is to be generated.

Another aspect of the present invention is a fundamental frequency pattern generating method wherein when a fundamental frequency pattern of a sentence phrase formed by connecting a plurality of accent phrases is generated, one or a plurality of the following characteristics:

a start point; a peak; an accent nucleus; an accent fall; an accent phrase end; and an end point of a fundamental frequency pattern stored in a fundamental frequency data base that stores a fundamental frequency pattern of the accent phrase and obtained from the fundamental frequency data base are changed by use of a predetermined rule based on a position of the accent phrase in the sentence phrase.

Still another aspect of the present invention is a fundamental frequency pattern generating method wherein when a fundamental frequency pattern of a sentence phrase formed by connecting a plurality of accent phrases is generated, one or a plurality of the following characteristics:

a start point; a peak; an accent nucleus; an accent fall; an accent phrase end; and an end point of a fundamental frequency pattern obtained from a fundamental frequency data base that stores a fundamental frequency pattern of the accent phrase are changed by use of a predetermined rule based on the number of phonological segments from a predetermined position of the sentence phrase to a phonological segment immediately before a phonological segment including the characteristic for which the fundamental frequency is to be generated.

Still yet another aspect of the present invention is a fundamental frequency pattern generating method for generating a fundamental frequency pattern for each accent phrase, wherein by changing one or a plurality of the following characteristics: an accent fall; an accent phrase end; and an end point of the accent phrase for which the fundamental frequency pattern is to be generated, a difference between fundamental frequencies of the accent phrase end and the end point of the accent phrase and a fundamental frequency of a start point of an accent phrase next to the accent phrase is not more than a predetermined threshold value.

A further aspect of the present invention is a fundamental frequency pattern generator for generating a fundamental frequency of an accent phrase comprising:

a fundamental frequency data base storing (1) a fundamental frequency pattern obtained by standardizing a fundamental frequency pattern of at least one of the following phonological segments by a time length of the phonological segment: a first phonological segment of the accent phrase; a phonological segment where the fundamental frequency takes a maximum value; a phonological segment of an accent nucleus and a phonological segment next to the accent nucleus; and one phonological segment at an end, or (2) a fundamental frequency pattern obtained by standardizing a fundamental frequency pattern of a phoneme included in at least one of said phonological segments by a time length of the phoneme; and a fundamental frequency pattern generating portion for setting (3) fundamental frequency patterns of all or part of the following phonological segments: the first phonological segment of the accent phrase for which the fundamental frequency is to be generated; the phonological segment where the fundamental frequency takes the maximum value in the accent phrase; the phonological segment of the accent nucleus and the phonological segment next to the accent nucleus in the accent phrase; and the phonological segment of the end of the accent phrase, or (4) a fundamental frequency pattern of each phoneme included in said phonological segments with reference to the fundamental frequency data base, said fundamental frequency pattern generating portion interpolating by a function on a real time axis a fundamental frequency pattern between the phonological segments or between the phonemes which fundamental frequency pattern has not been set in a stage of the fundamental frequency pattern setting.

A further aspect of the present invention is a fundamental frequency pattern generator for generating a fundamental frequency of an accent phrase comprising:

a fundamental frequency data base storing a fundamental frequency pattern standardized by a time length of each phoneme included in a phonological segment classified according to one or both of the number of phonological segments and an accent position;

a microprosody data base storing a difference between a fundamental frequency of each phonological segment or each phoneme string standardized by a time length of the phoneme and the frequency pattern, said difference being classified according to a phonological segment or a phoneme string; and a fundamental frequency pattern generating portion for generating the fundamental frequency of the accent phrase by setting a fundamental frequency pattern of each accent phrase with reference to the fundamental frequency data base, obtaining a value corresponding to a phoneme or a phonological segment string for which the fundamental frequency is to be generated, and adding the corresponding value to the set fundamental frequency or subtracting the corresponding value from the set fundamental frequency.

Another aspect of the present invention is a fundamental frequency pattern generator comprising:

an accent phrase position fundamental frequency data base storing a fundamental frequency pattern of an accent phrase, said fundamental frequency pattern being classified according to a position of the accent phrase in a sentence phrase formed by connecting a plurality of accent phrases, and to whether the accent phrase is situated at an end of a sentence or not; and a fundamental frequency pattern generating portion for setting fundamental frequency patterns of the accent phrases constituting the sentence phrase with reference to the accent phrase position fundamental frequency data base.

BRIEF DESCRIPTION OF THE DRAWINGS

FIGS. 14(A),1 4(B) are view showing an example of the fundamental frequency pattern according to the present invention;

DESCRIPTION OF THE REFERENCE NUMERALS

10 character string input portion

20 character string analyzing portion

Figure 1:
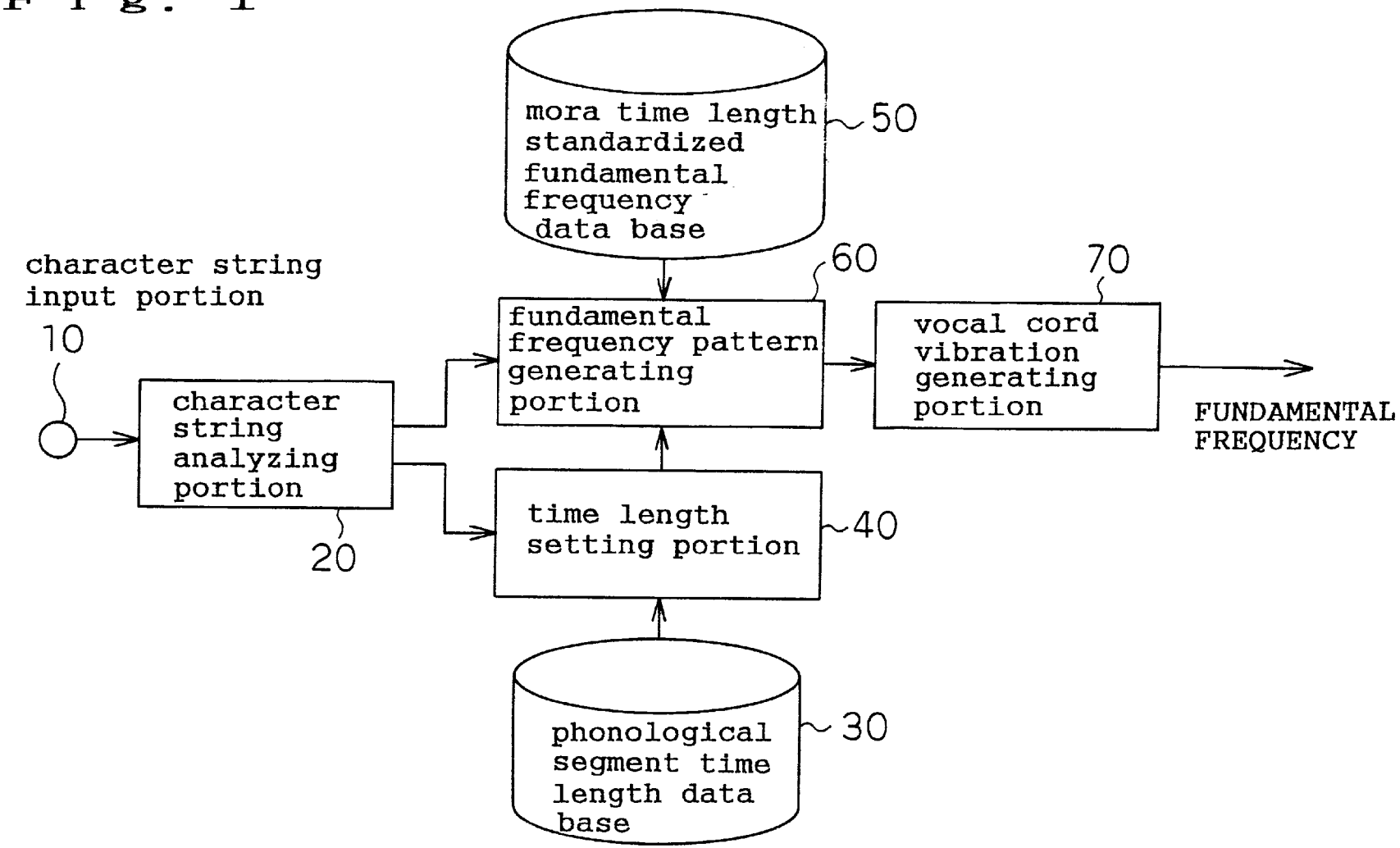
FIG. 1 is a function block diagram of a fundamental frequency generator according to the present invention.

30 phonological segment time length data base

40 time length setting portion

50 mora tine length standardized fundamental frequency data base

60 fundamental frequency pattern generating portion

70 vocal cord vibration generating portion

150 vowel time length standardized fundamental frequency data base

250 microprosody data base

350 fundamental frequency pattern variation data base

450 accent phrase position fundamental frequency data base

DETAILED DESCRIPTION OF THE PREFERRED EMBODIMENT

Hereinafter, embodiments of the present invention will be described with reference to FIGS. 1 to 19.

First Embodiment

Figure 2:
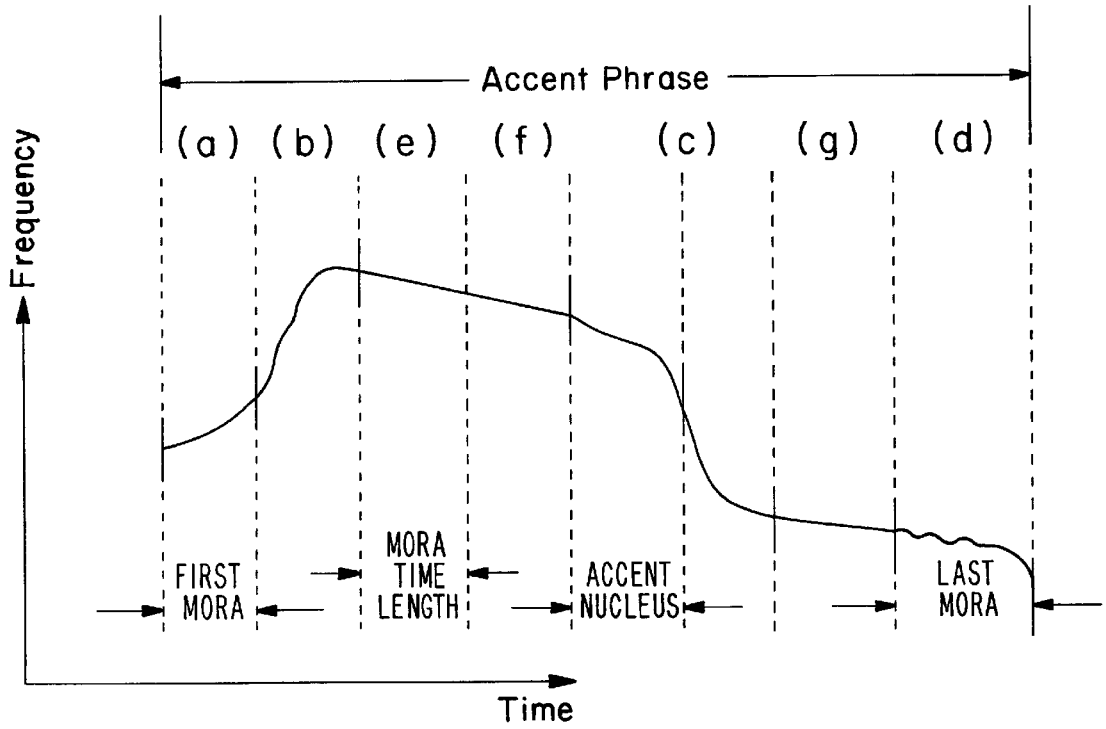
FIG. 2 is a view showing an example of a fundamental frequency pattern generated by a first embodiment of the present invention.

FIG. 1 is a function block diagram of an apparatus showing an embodiment of the present invention. In FIG. 1, reference numeral 10 represents a character string input portion for inputting a character string on which speech synthesis is performed. Reference numeral 20 represents a character string analyzing portion for analyzing the character string input from the character string input portion 10 and outputting phonological segment information and rhythm information such as the accent and pause of the speech to be synthesized. Reference numeral 30 represents a phonological segment time length data base that stores the time length of each phonological segment for each of the conditions such as the utterance speed and the phonological segment position during utterance. Reference numeral 40 represents a time length setting portion for setting the time length of each phonological segment with reference to the phonological segment time length data base 30 based on the phonological segment information and the rhythm information output from the character string analyzing portion 20. Reference numeral 50 represents a mora time length standardized fundamental frequency data base that stores the fundamental frequency pattern of each mora standardized by the time length of the mora with respect to conditions of factors that decide the rhythm such as the number of morae, the accent type and the phonological segment string of the accent phrase. Reference numeral 60 represents a fundamental frequency pattern generating portion for generating the fundamental frequency pattern with reference to the mora time length standardized fundamental frequency data base 50 based on the rhythm information output from the character analyzing portion 20 and the time length of the phonological segment set by the time length setting portion 40. Reference numeral 70 represents a vocal cord vibration generating portion for generating vocal cord vibrations based on the fundamental frequency pattern output from the fundamental frequency pattern generating portion. The vocal cord vibration generating portion 70 generates sound source vibrations of the synthesized speech. FIG. 2 shows an example of the fundamental frequency pattern of the present invention.

The operation of the fundamental frequency pattern generator structured as described above will hereinafter be described.

First, a character string (in FIG. 2, a character string "オンセーゴーセー" meaning speech synthesis) to be converted into speech is input from the character string input portion 10. The character string analyzing portion 20 analyzes the input character string, outputs phonological segment information representative of a phoneme string to the time length setting portion 40, divides the character string into accent phrases, and outputs rhythm information representative of the number of morae and the accent type of each accent phrase and the phonological segment information representative of the phoneme string to the fundamental frequency pattern generating portion 60. The time length setting portion 40 sets the time length of each phoneme with reference to the phonological segment time length data base 30 based on the phonological segment information input from the character string analyzing portion 20, and outputs time length information to the fundamental frequency pattern generating portion 60. The fundamental frequency pattern generating portion 60 generates the fundamental frequency pattern for each accent phrase based on the rhythm information and the phonological segment information input from the character string analyzing portion 20 and the time length information input from the time length setting portion 40.

First, as shown at (a) in FIG. 2, the fundamental frequency pattern of the first mora of the accent phrase is obtained from the mora time length standardized fundamental frequency data base 50. Then, the mora of which the fundamental frequency takes the maximum value is identified based on the number of morae and the accent type of the accent phrase, and as shown at (b) in FIG. 2, the fundamental frequency pattern of the identified mora is obtained from the mora time length standardized fundamental frequency data base 50. As shown at (c) and (d) in FIG. 2, the fundamental frequency patterns of the mora of the accent nucleus and the mora next to the accent nucleus and the fundamental frequency pattern of the last mora of the accent phrase are obtained from the mora time length standardized fundamental frequency data base 50. By use of linear interpolation on the real time axis for the intervals between the morae serving as the references as shown at (b) and (C), and (c) and (d) in FIG. 2, the fundamental frequency patterns of (e), (f) and (g) in FIG. 2 are decided. The voice cord vibration generating portion 70 generates voice cord vibrations of the synthesized speech in accordance with the fundamental frequency pattern output from the fundamental frequency pattern generating portion 60.

By applying the fundamental frequency pattern obtained by standardizing by the time length of the mora concerned the timing and the angle of the rise of the accent phrase and the fall at the accent nucleus which timing and angle largely affect the naturalness of speech, variation in fundamental frequency in the mora is reproduced in detail and high naturalness is realized. With respect to portions not largely affecting hearing, by performing interpolation on the real time axis, the sense of discontinuity in performing control for each mora is removed and the size of the fundamental frequency pattern data base can be reduced.

Second Embodiment

Figure 4:
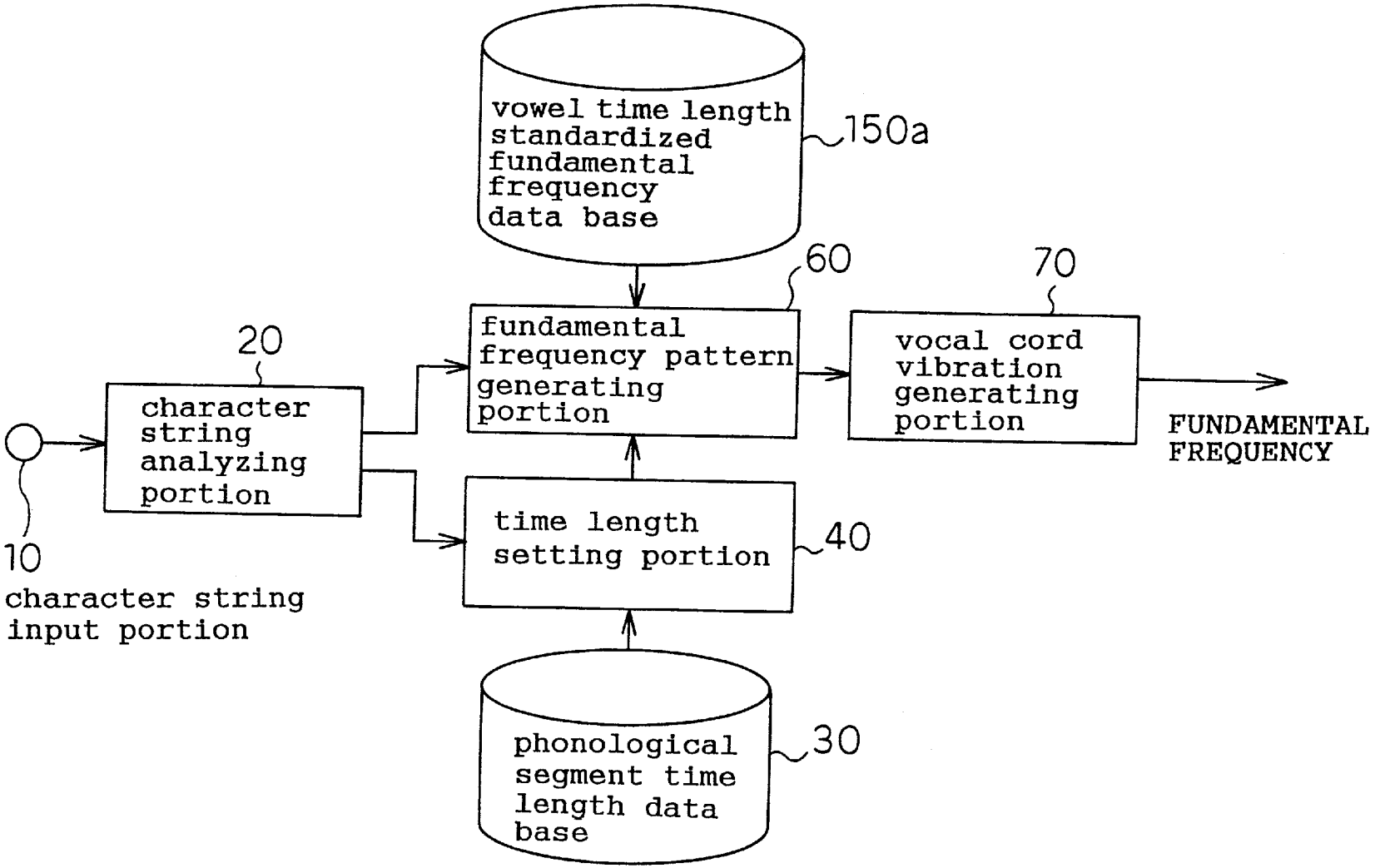
FIG. 4 is a function block diagram of an apparatus showing an embodiment of the present invention.

FIG. 4 is a function block diagram of an apparatus showing an embodiment of the present invention. FIG. 4 is the same as FIG. 1 except that the mora time length standardized fundamental frequency data base 50 is replaced by a vowel time length standardized fundamental frequency data base 150*a*. The time length of the vowel portion of each mora is divided into four equal sections with respect to conditions of factors that decide the rhythm such as the number of morae, the accent type and the phonological segment string of the accent phrase, and the typical value of the fundamental frequency of each section is stored in the vowel time length standardized fundamental frequency data base 150*a* as the value of the central point of the section.

Figure 3:
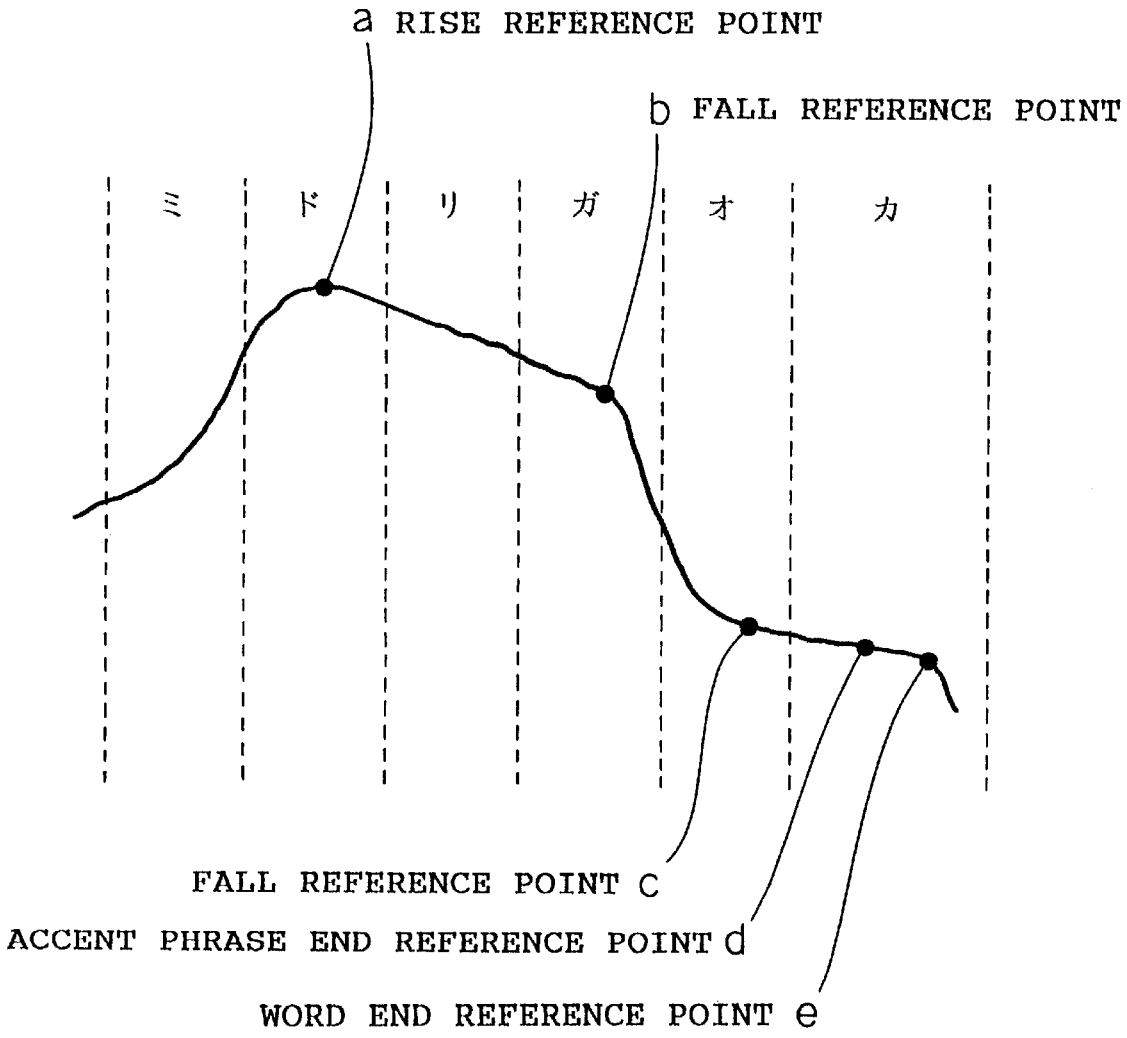
FIG. 3 is a view showing an example of a fundamental frequency pattern generated by a second embodiment of the present invention.

FIG. 3 shows an example of the fundamental frequency pattern according to the present invention. The operation thereof will hereinafter be described. First, a character string to be converted into speech is input from the character input portion 10. The character string analyzing portion 20 analyzes the input character string, outputs phonological segment information representative of a phoneme string to the time length setting portion 40, divides the character string into accent phrases, and outputs rhythm information representative of the number of morae and the accent type of each accent phrase and the phonological segment information representative of the phoneme string to the fundamental frequency pattern generating portion 60. The time length setting portion 40 sets the time length of each phoneme with reference to the phonological segment time length data base 30 based on the phonological segment information input from the character string analyzing portion 20, and outputs time length information to the fundamental frequency pattern generating portion 60. The fundamental frequency pattern generating portion 60 generates the fundamental frequency pattern for each accent phrase based on the rhythm information and the phonological segment information input from the character string analyzing portion 20 and the time length information input from the time length setting portion 40.

First, based on the number of morae, the accent type and the phonological segment string of the accent phrase, the following reference points are obtained from the vowel time length standardized fundamental frequency data base 150*a*: a) a rise reference point at the center of the third section of the four equal sections of the vowel corresponding portion of the mora of which the fundamental frequency takes the maximum value; b) a fall reference point at the center of the third section of the four equal sections of the vowel corresponding portion of the mora corresponding to the accent nucleus; c) a fall reference point at the center of the third section of the four equal sections of the vowel corresponding portion of the mora next to the accent nucleus; d) an accent phrase end reference point at the center of the second section of the four equal sections of the vowel corresponding portion of the last mora of the accent phrase; and e) a word end reference point at the center of the third section of the four equal sections of the vowel corresponding portion of the last mora.

Then, each of the reference points is set at a position relative to the vowel time length of the corresponding mora. In order that a) the rise reference point takes the maximum value, the interval between the head of the accent phrase to a) the rise reference point is interpolated on the real time axis by use of the critical damping quadratic linear system on the logarithmic frequency axis. For each section, the interval between each two points of the reference points of a) to d) is interpolated on the real time axis by use of the critical damping quadratic linear system on the logarithmic frequency axis. When the end of the accent phrase is the end of the utterance, the interval between d) the accent phrase end reference point and e) the word end reference point is interpolated by a word end function which is a function on the real time axis. The voice cord vibration generating portion 70 generates voice cord vibrations of the synthesized speech in accordance with the fundamental frequency pattern output from the fundamental frequency pattern generating portion 60.

By setting the timing of the rise of the accent phrase and the fall at the accent nucleus which timing largely affects the naturalness of speech on the time axis standardized by the vowel length of the mora concerned, the timing of variation in fundamental frequency in the mora is reproduced in detail. With respect to the rise and fall angles, by using the function on the real time axis, a smooth fundamental frequency pattern can be obtained in which the rise and the fall are stable without being affected by the difference in time length due to the phonological segment, so that high naturalness is realized. With respect to portions not largely affecting hearing, by performing interpolation on the real time axis, the sense of discontinuity in performing control for each mora is removed and the size of the fundamental frequency pattern data base can be reduced.

Third Embodiment

A function block diagram of an apparatus showing an embodiment of the present invention is not shown because it is the same as FIG. 4 except that the data base 150*a* of the above-described second embodiment is replaced by a vowel time length standardized fundamental frequency data base 150*b* that stores the fundamental frequency pattern of the vowel portion of each mora standardized by the time length of the vowel portion of each mora and the fundamental frequency of the head of the accent phrase with respect to conditions of factors that decide the rhythm such as the number of morae, the accent type and the phonological segment string of an accent phrase.

Figure 5:
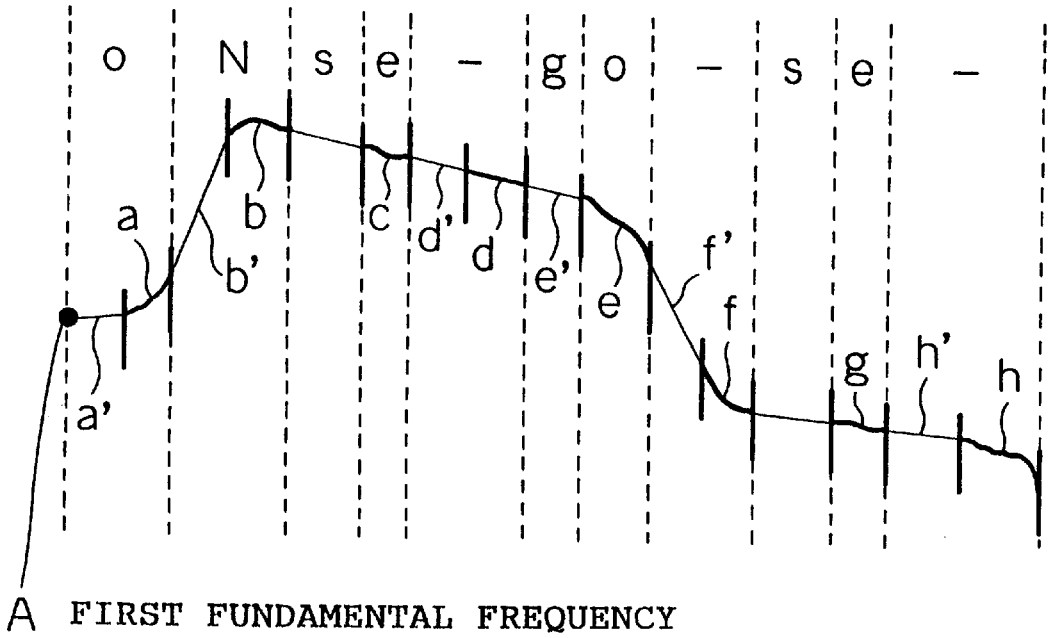
FIG. 5 is a view showing an example of the fundamental frequency pattern according to the present invention.

FIG. 5 shows an example of the fundamental frequency pattern according to the present invention.

The operation of the fundamental frequency pattern generator structured as described above will hereinafter be described.

First, a character string (in FIG. 5, a character string "oNse-go-se-" meaning speech synthesis) to be converted into speech is input from the character string input portion 10. The character string analyzing portion 20 analyzes the input character string, outputs phonological segment information representative of a phoneme string to the time length setting portion 40, divides the character string into accent phrases, and outputs rhythm information representative of the number of morae and the accent type of each accent phrase and the phonological segment information representative of the phoneme string to the fundamental frequency pattern generating portion 60. The time length setting portion 40 sets the vowel time length of each mora or the time length of the vowel corresponding portion in the monophthong syllable, in the syllabic nasal or in the long vowel with reference to the phonological segment time length data base 30 based on the phonological segment information input from the character string analyzing portion 20, and outputs time length information to the fundamental frequency pattern generating portion 60. The fundamental frequency pattern generating portion 60 generates the fundamental frequency pattern for each accent phrase based on the rhythm information and the phonological segment information input from the character string analyzing portion 20 and the time length information input from the time length setting portion 40.

First, as shown at A in FIG. 5, the fundamental frequency of the head of the accent phrase is obtained from the vowel time length standardized fundamental frequency data base 150*b*. Then, as shown at a) in FIG. 5, the fundamental frequency pattern of the vowel portion of the first mora of the accent phrase is obtained from the vowel time length standardized fundamental frequency data base 150*b*. In this embodiment, since the first mora is a monophthong syllable, as shown at a) in FIG. 5, the fundamental frequency pattern obtained from the vowel time length standardized fundamental frequency data base 150*b* is applied to the latter half of the time length of the mora concerned. For each of b), c), d), e), f), g) and h), the fundamental frequency pattern of the vowel portion of the mora concerned is similarly obtained from the vowel time length standardized fundamental frequency data base 150*b*. For b) which is a syllabic nasal and d), f) and h) which are long vowels, the fundamental frequency patterns obtained from the vowel time length standardized fundamental frequency data base 150*b* are similarly applied to the latter halves of the time lengths of the morae concerned. Then, the fundamental frequencies of the first halves of the monophthong syllable, the syllabic nasal and the long vowel or the fundamental frequencies of a'), b'), d'), e'), f') and h') of the voiced consonants are generated by use of linear interpolation on the real time axis based on the preceding and succeeding fundamental frequencies. The voice cord vibration generating portion 70 generates voice cord vibrations of the synthesized speech in accordance with the fundamental frequency pattern output from the fundamental frequency pattern generating portion 60.

By applying the fundamental frequency pattern obtained by standardizing by the vowel time length of the mora concerned the timing and the angle of the rise of the accent phrase and the fall at the accent nucleus which timing and angle largely affect the naturalness of speech, variation in fundamental frequency in the mora is reproduced in detail and high naturalness is realized. With respect to portions not largely affecting hearing, by performing interpolation on the real time axis, the sense of discontinuity in performing control for each mora is removed and the size of the fundamental frequency pattern data base can be reduced.

Fourth Embodiment

Figure 6:
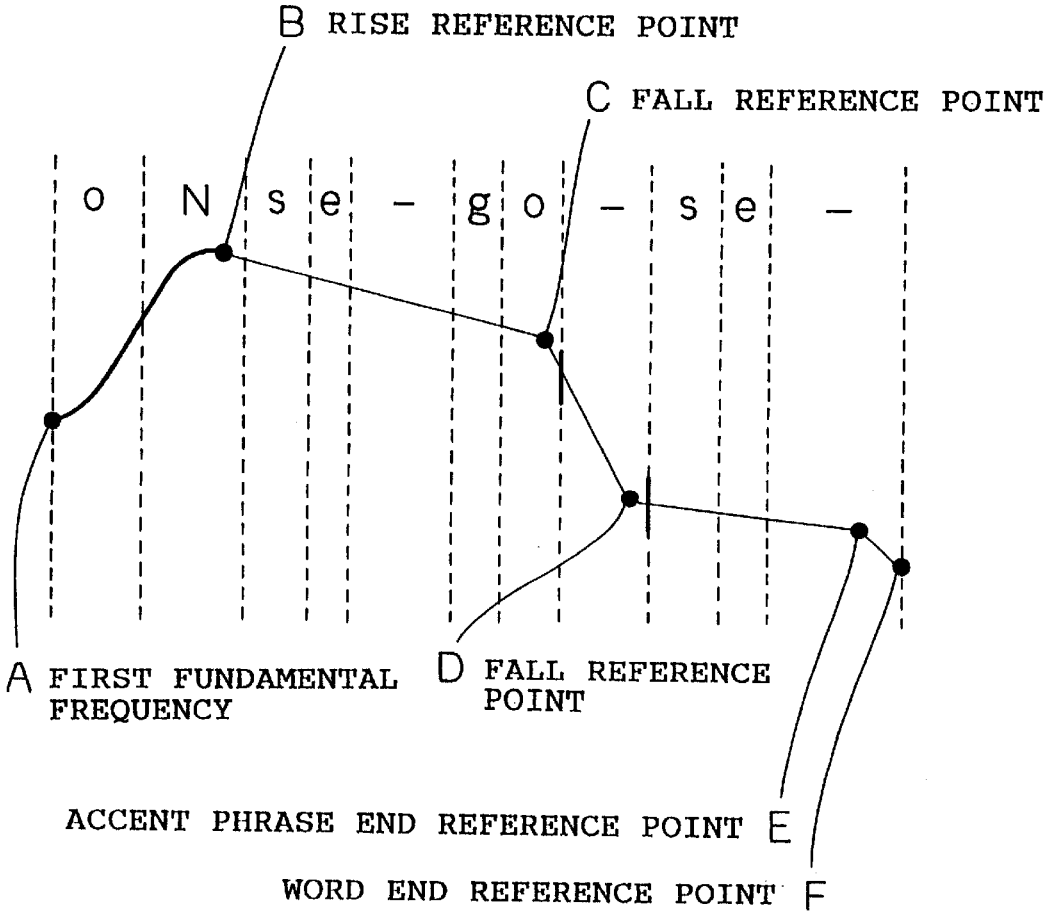
FIG. 6 is a view showing an example of the fundamental frequency pattern according to the present invention.

In the fourth embodiment, the vowel time length standardized fundamental frequency data base 150*a* is a vowel time length standardization fundamental frequency data base in which with respect to conditions of factors that decide the rhythm such as the number of morae, the accent type and the phonological segment string of the accent phrase, A) the first fundamental frequency, B) a rise reference point, C) a fall reference point (accent nucleus), D) a fall reference point (immediately after the accent nucleus), E) an accent phrase end reference point, and F) a word end reference point are stored at positions relative to the vowel time lengths of the morae including the reference points. The structure of the other parts of the apparatus is the same as that of FIG. 4. FIG. 6 shows an example of the fundamental frequency pattern according to the present invention. The operation thereof will hereinafter be described.

First, a character string to be converted into speech is input from the character string input portion 10. The character string analyzing portion 20 analyzes the input character string, outputs phonological segment information representative of a phoneme string to the time length setting portion 40, divides the character string into accent phrases, and outputs rhythm information representative of the number of morae and the accent type of each accent phrase and the phonological segment information representative of the phoneme string to the fundamental frequency pattern generating portion 60. The time length setting portion 40 sets the time length of each phoneme with reference to the phonological segment time length data base 30 based on the phonological segment information input from the character string analyzing portion 20, and outputs time length information to the fundamental frequency pattern generating portion 60. The fundamental frequency pattern generating portion 60 generates the fundamental frequency pattern for each accent phrase based on the rhythm information and the phonological segment information input from the character string analyzing portion 20 and the time length information input from the time length setting portion 40. First, based on the number of morae, the accent type and the phonological segment string of the accent phrase, the reference points of A) to F) are obtained from the vowel time length standardized fundamental frequency data base 150*a*. Then, each of the reference points is set at a position relative to the vowel length of the corresponding mora. The interval between A) the first fundamental frequency to B) the rise reference point is generated by use of a function on the real axis. Further, the fundamental frequency pattern between each two points of the reference points of B) to F) is generated by performing interpolation by a straight line on the real time axis.

The voice cord vibration generating portion 70 generates voice cord vibrations of the synthesized speech in accordance with the fundamental frequency pattern output from the fundamental frequency pattern generating portion 60.

By setting the timing of the rise of the accent phrase and the fall at the accent nucleus which timing largely affects the naturalness of speech on the time axis standardized by the vowel length of the mora concerned, the timing of variation in fundamental frequency in the mora is reproduced in detail. With respect to the rise and fall angles, by using the function on the real time axis, a smooth fundamental frequency pattern can be obtained in which the rise and the fall are stable without being affected by the difference in time length due to the phonological segment, so that high naturalness is realized. With respect to portions not largely affecting hearing, by performing interpolation on the real time axis, the sense of discontinuity in performing control for each mora is removed and the size of the fundamental frequency pattern data base can be reduced.

Fifth Embodiment

Figure 7:
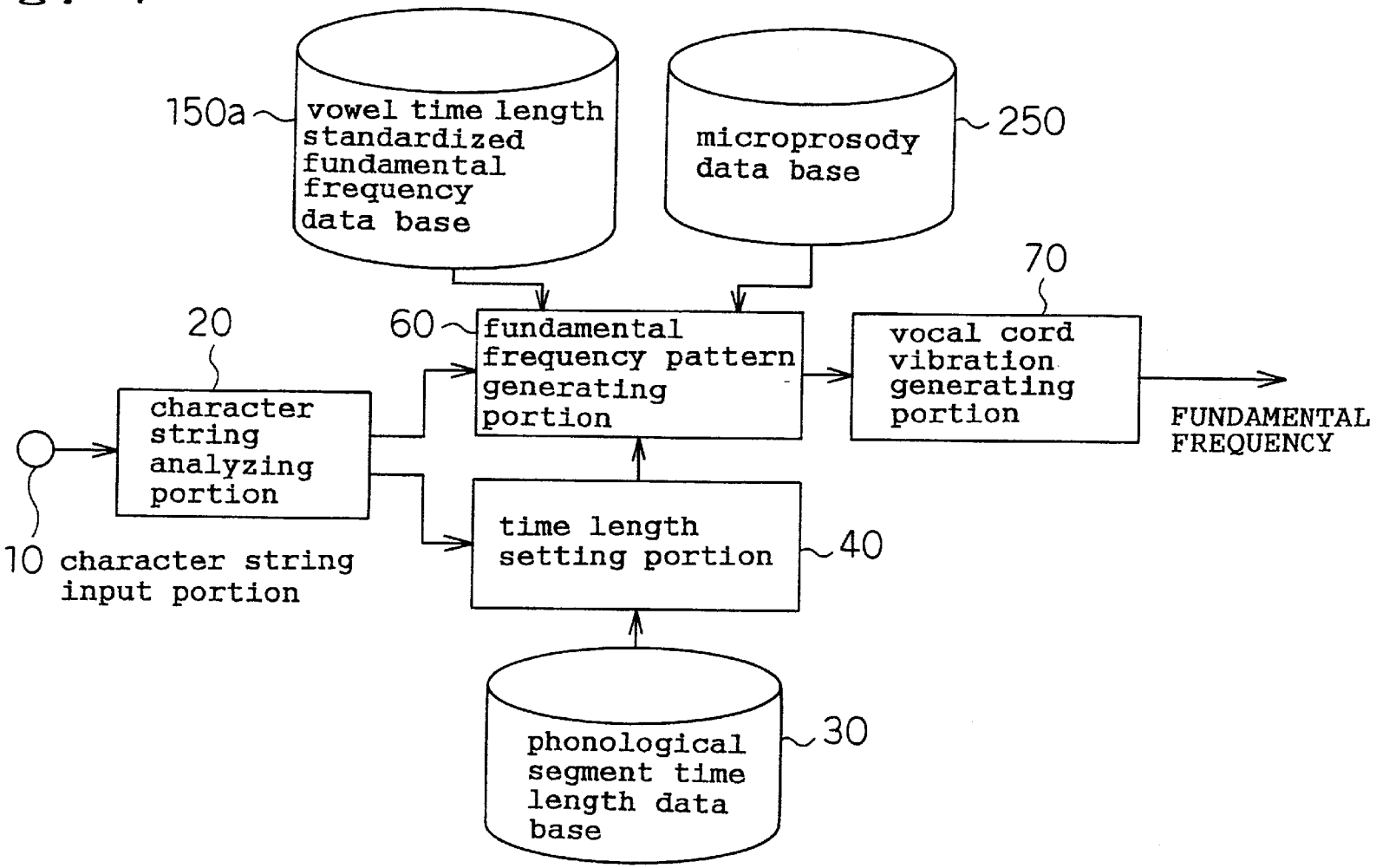
FIG. 7 is a function block diagram of an apparatus showing an embodiment of the present invention.

FIG. 7 is a function block diagram of an apparatus showing an embodiment of the present invention. FIG. 7 is the same as FIG. 4 except that in the vowel time length standardized fundamental frequency data base 150*a*, with respect to conditions of the number of morae and the accent type of the accent phrase, a) a rise reference point, b) a fall reference point (accent nucleus), c) a fall reference point (immediately after the accent nucleus), d) an accent phrase end reference point, and e) a word end reference point are stored at positions relative to the time lengths of the vowels or the vowel corresponding portions of the morae including the reference points, and that a microprosody data base 250 is added that stores fine variation in fundamental frequency due to the phonological segment or the phoneme string by standardizing by the time length of the phoneme the differences between the reference points stored in the vowel time length standardized fundamental frequency data base 150*a* and the values obtained by interpolating the intervals between the reference points.

Figure 8:
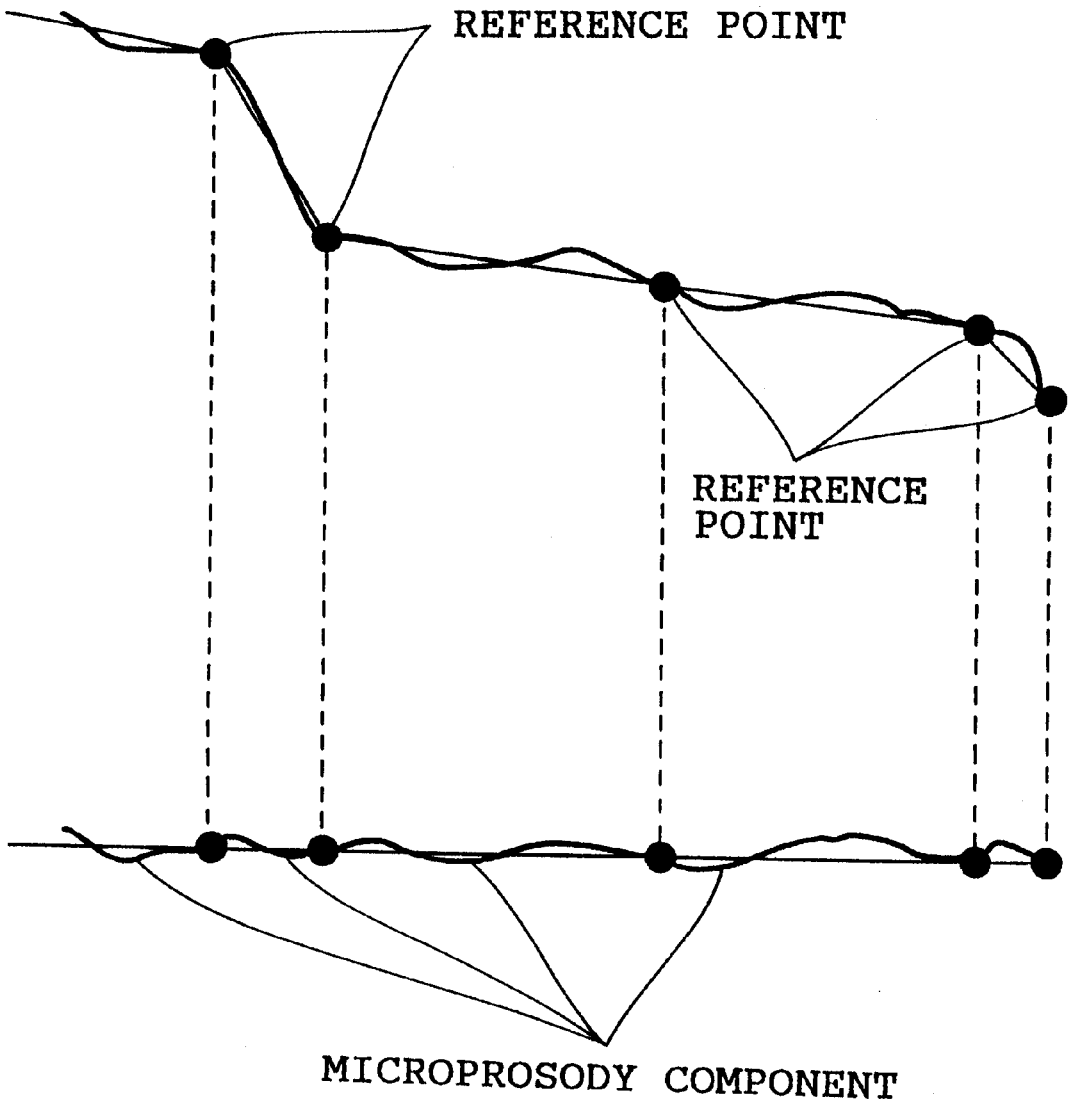
FIG. 8 is a schematic view of microprosody components stored in a microprosody data base 250.
Figure 9:
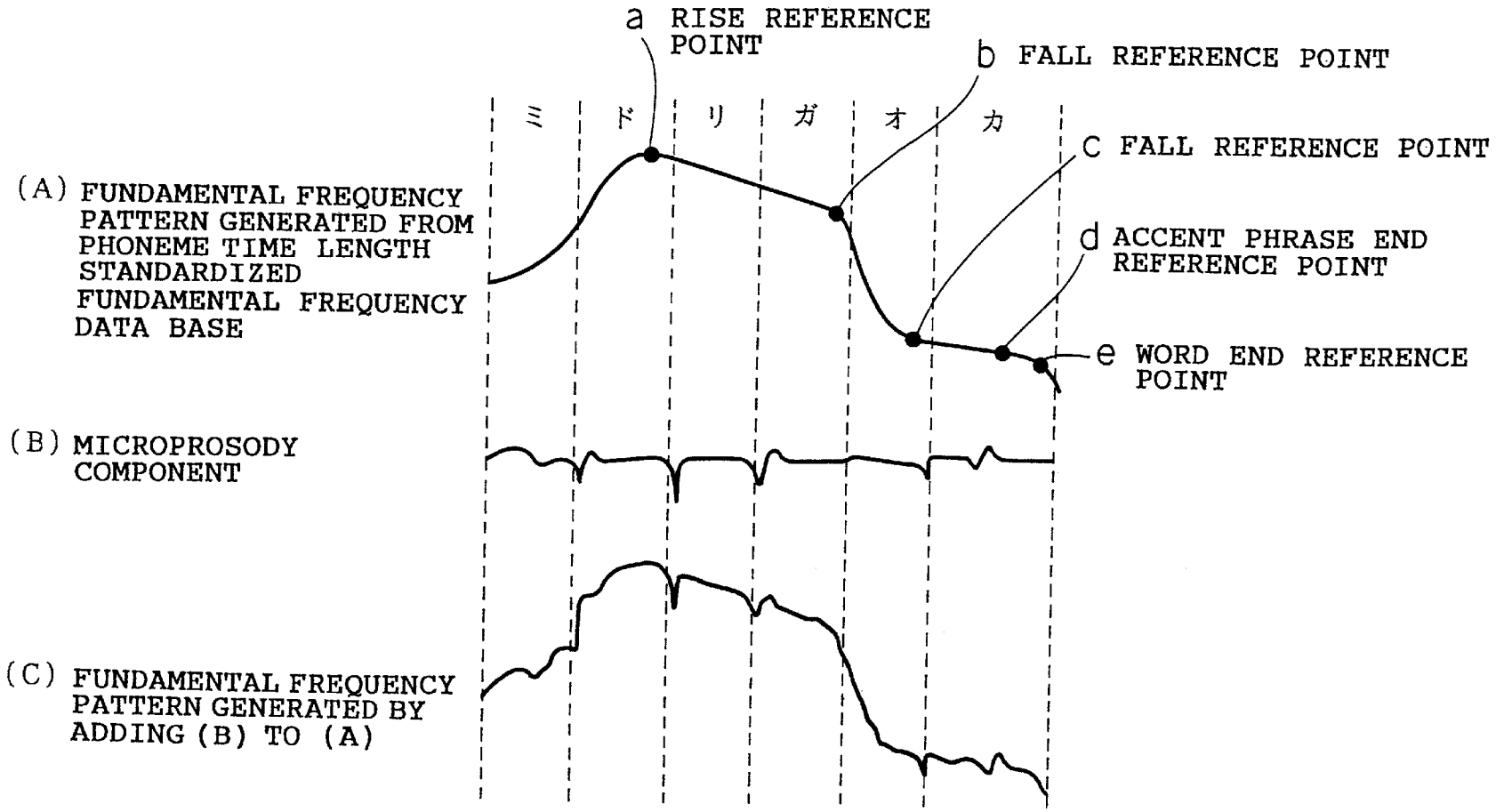
FIG. 9 is a view showing an example of the fundamental frequency pattern according to the present invention.

FIG. 8 is a schematic view of microprosody components stored in the microprosody data base 250. FIG. 9 shows an example of the fundamental frequency pattern according to the present invention.

The operation of the fundamental frequency pattern generator structured as described above will hereinafter be described.

First, a character string to be converted into speech is input from the character string input portion 10. The character string analyzing portion 20 analyzes the input character string, outputs phonological segment information representative of a phoneme string to the time length setting portion 40, divides the character string into accent phrases, and outputs rhythm information representative of the number of morae and the accent type of each accent phrase and the phonological segment information representative of the phoneme string to the fundamental frequency pattern generating portion 60. The time length setting portion 40 sets the time length of each phoneme of each mora with reference to the phonological segment time length data base 30 based on the phonological segment information input from the character string analyzing portion 20, and outputs time length information to the fundamental frequency pattern generating portion 60. The fundamental frequency pattern generating portion 60 generates the fundamental frequency pattern for each accent phrase based on the rhythm information and the phonological segment information input from the character string analyzing portion 20 and the time length information input from the time length setting portion 40. First, based on the number of morae and the accent type of the accent phrase, the following reference points are obtained from the vowel time length standardized fundamental frequency data base: a) a rise reference point at the center of the third section of the four equal sections of the vowel corresponding portion of the mora of which the fundamental frequency takes the maximum value; b) a fall reference point at the center of the third section of the four equal sections of the vowel corresponding portion of the mora corresponding to the accent nucleus; c) a fall reference point at the center of the third section of the four equal sections of the vowel corresponding portion of the mora next to the accent nucleus; d) an accent phrase end reference point at the center of the second section of the four equal sections of the vowel corresponding portion of the last mora of the accent phrase; and e) a word end reference point at the center of the third section of the four equal sections of the vowel corresponding portion of the last mora.

Then, each of the reference points is set at a position relative to the vowel time length of the corresponding mora. In order that a) the rise reference point takes the maximum value, the interval between the head of the accent phrase to a) the rise reference point is interpolated on the real time axis by use of the critical damping quadratic linear system on the logarithmic frequency axis. For each section, the interval between each two points of the reference points of a) to e) is interpolated on the real time axis by use of the critical damping quadratic linear system on the logarithmic frequency axis to generate a fundamental frequency pattern as shown at (A) of FIG. 9. Then, fine variation in fundamental frequency corresponding to each phoneme is obtained from the microprosody data base 250, and the obtained variation is expanded or compressed in accordance with the time length of each phoneme and applied as shown at (B) of FIG. 9. The fine vibration of (B) is added to the fundamental frequency of (A) to thereby generate a fundamental frequency pattern as shown at (C). The voice cord vibration generating portion 70 generates voice cord vibrations of the synthesized speech in accordance with the fundamental frequency pattern output from the fundamental frequency pattern generating portion 60.

By setting the timing of the rise of the accent phrase and the fall at the accent nucleus on the axis standardized by the time length of the phoneme of the mora concerned, the timing of variation in fundamental frequency in the mora is reproduced in detail, and by adding fine variation in fundamental frequency which largely affects the naturalness and clarity of speech, high naturalness and clarity are realized.

Sixth Embodiment

Figure 10:
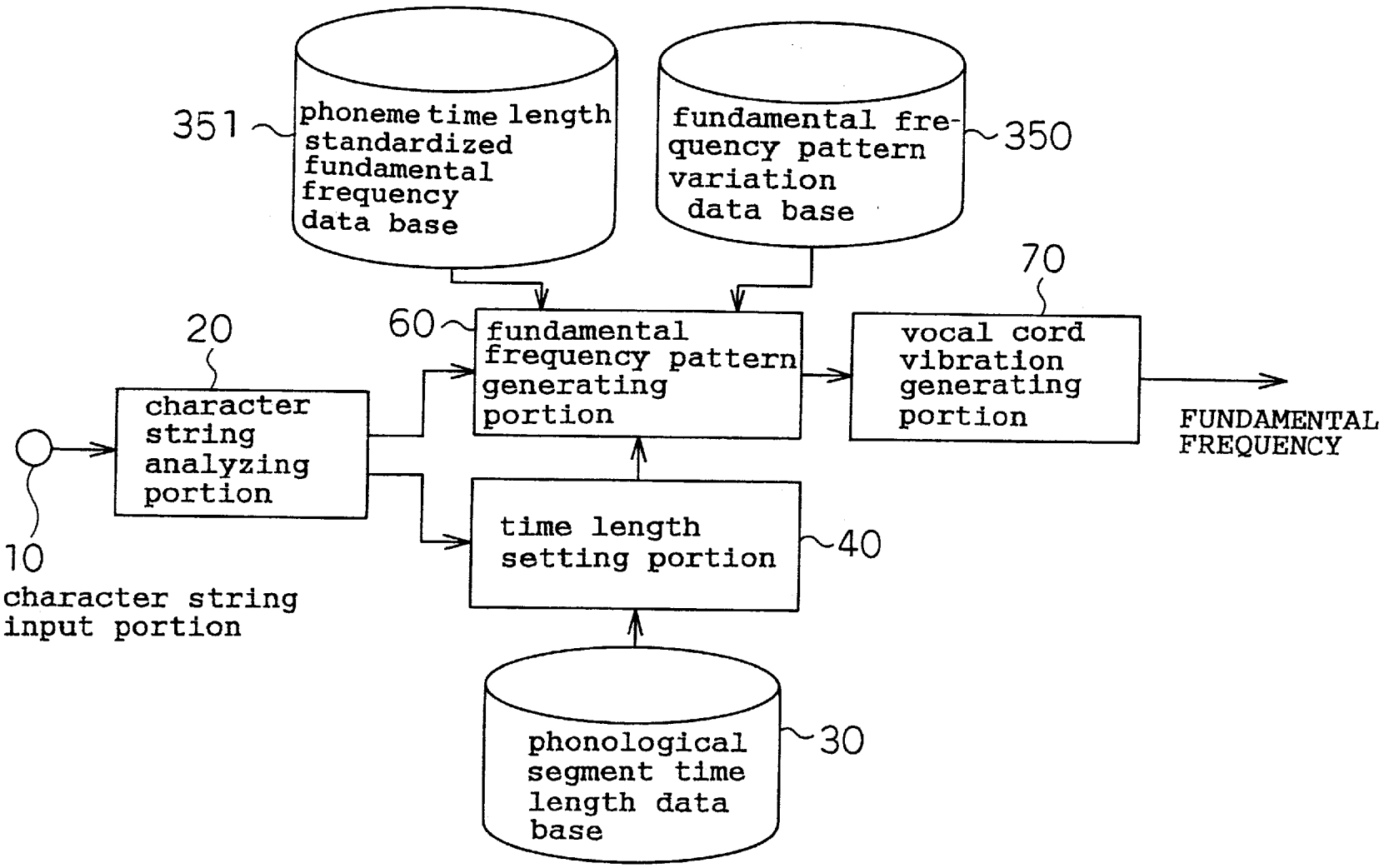
FIG. 10 is a function block diagram of an apparatus showing an embodiment of the present invention.

FIG. 10 is a function block diagram of an apparatus showing an embodiment of the present invention. FIG. 10 is the same as FIG. 1 except that the mora time length standardized fundamental frequency data base 50 is replaced by a phoneme time length standardized fundamental frequency data base 351 in which with respect to conditions of the number of morae and the accent type of the accent phrase, a) a rise reference point of the i-th mora which is the peak of the fundamental frequency pattern, b) a fall reference point (accent nucleus), c) a fall reference point (immediately after the accent nucleus) and d) an accent phrase end reference point of k morae at the end of the accent phrase are each stored at a position relative to the time length of the phoneme of the mora including the reference point, and that a fundamental frequency pattern variation data base 350 is added that stores the variation amounts of the fundamental frequencies at the peak and the end of the accent phrase for each position, in the sentence phrase, of the accent phrase for which the fundamental frequency is to be generated.

Figure 14A:
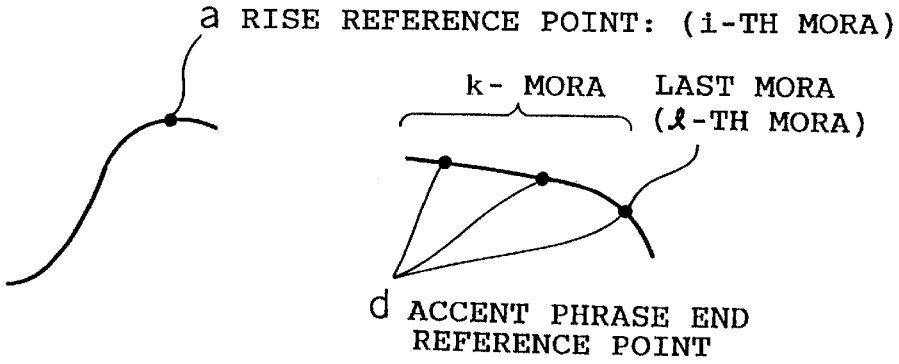
Figure 14B:
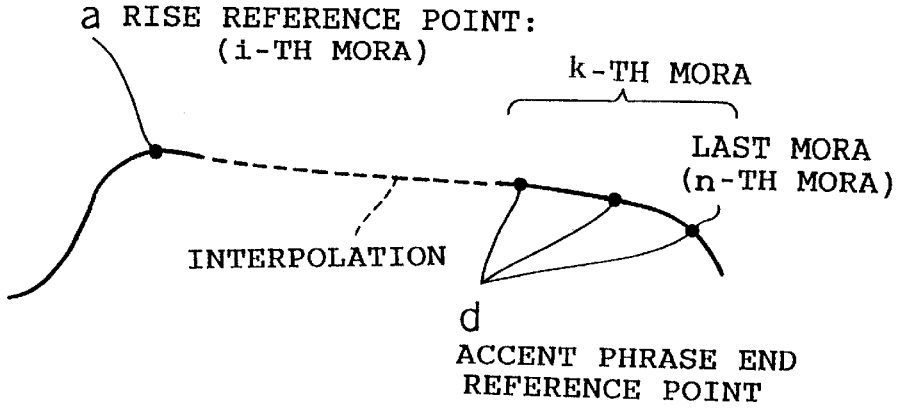
Figure 15:
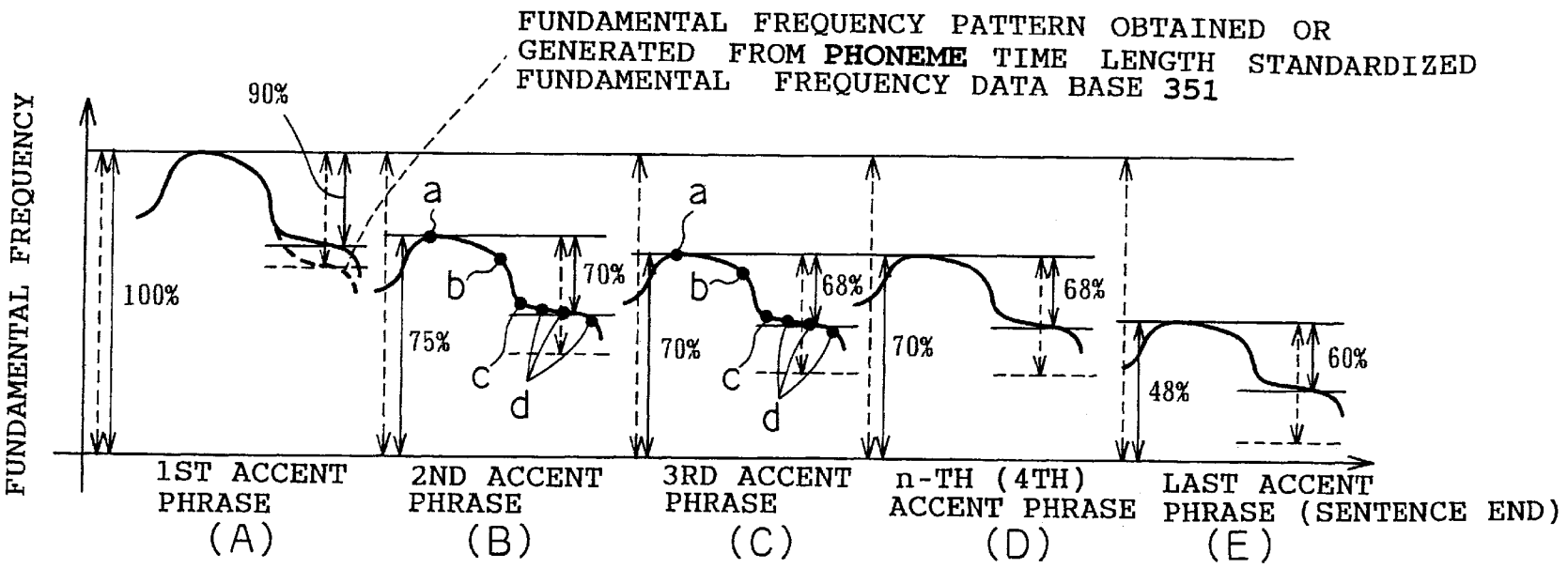
FIG. 15 is a schematic view of the fundamental frequency pattern according to the present invention.

FIGS. 11, 12, 13 and 14 are schematic views of the fundamental frequency patterns generated when the data of the fundamental frequency pattern corresponding to the number of morae and the accent type of the accent phrase for which the fundamental frequency is to be generated are not stored in the phoneme length standardized fundamental frequency data base 351. FIG. 15 is a schematic view of the fundamental frequency pattern of a sentence formed by connecting the fundamental frequency patterns of a plurality of accent phrases. The operation thereof will hereinafter be described.

First, a character string to be converted into speech is input from the character string input portion 10. The character string analyzing portion 20 analyzes the input character string, outputs phonological segment information representative of a phoneme string to the time length setting portion 40, divides the character string into accent phrases, and outputs rhythm information representative of the number of morae and the accent type of each accent phrase and the phonological segment information representative of the phoneme string to the fundamental frequency pattern generating portion 60. The time length setting portion 40 sets the time length of each phoneme with reference to the phonological segment time length data base 30 based on the phonological segment information input from the character string analyzing portion 20, and outputs time length information to the fundamental frequency pattern generating portion 60. The fundamental frequency pattern generating portion 60 generates the fundamental frequency pattern for each accent phrase based on the rhythm information and the phonological segment information input from the character string analyzing portion 20 and the time length information input from the time length setting portion 40.

First, based on the number of morae, the accent type and the phonological segment string of the accent phrase, a) a rise reference point, b) a fall reference point, c) a fall reference point and d) an accent phrase end reference point or d') a last mora are obtained from the phoneme time length standardized fundamental frequency data base 351.

Figure 11A:
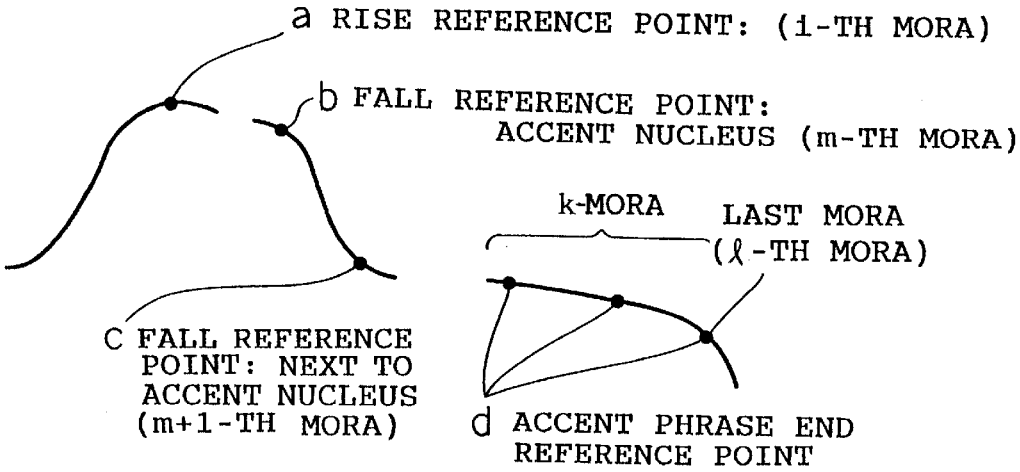
FIGS. 11(A) and 11(B) are view showing an example of the fundamental frequency pattern according to the present invention.
Figure 11B:
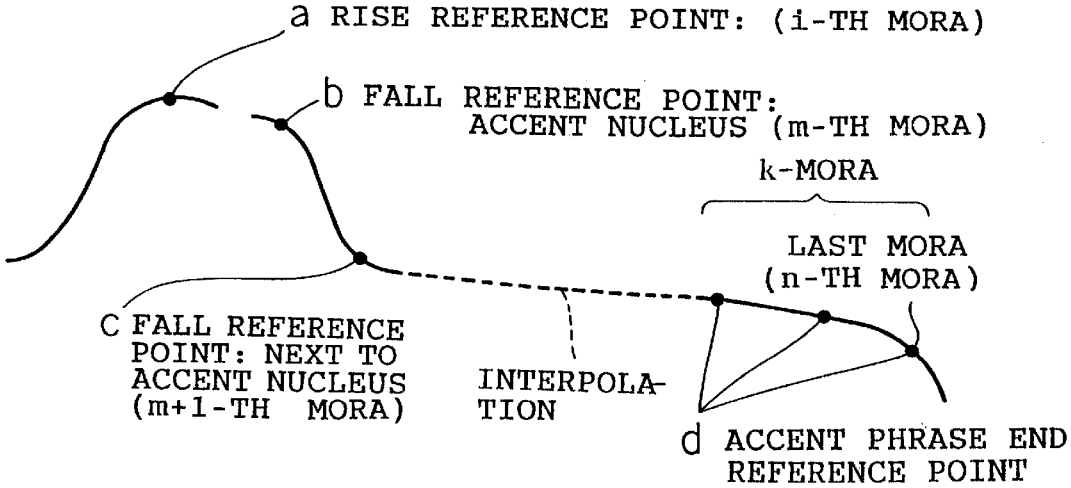

In a case where the data of the fundamental frequency pattern corresponding to the number of morae and the accent type of the accent phrase for which the fundamental frequency is to be generated are not stored in the phoneme time length standardized fundamental frequency data base 351, letting the number of morae of the accent phrase for which the fundamental frequency is to be generated be n and the accent type thereof be an m type, when m is not more than i+1, as shown in FIG. 11(A), a) to d) of a fundamental frequency pattern of 1-mora m type in which the accent type is the m type and the number of morae is closest to n are obtained from the phoneme time length standardized fundamental frequency data base 351, and as shown in FIG. 11(B), d) obtained from the phoneme time length standardized fundamental frequency data base 351 is set as the reference points of the n−k+1-th mora to the n-th mora of the accent phrase for which the fundamental frequency is to be generated.

Figure 12A:
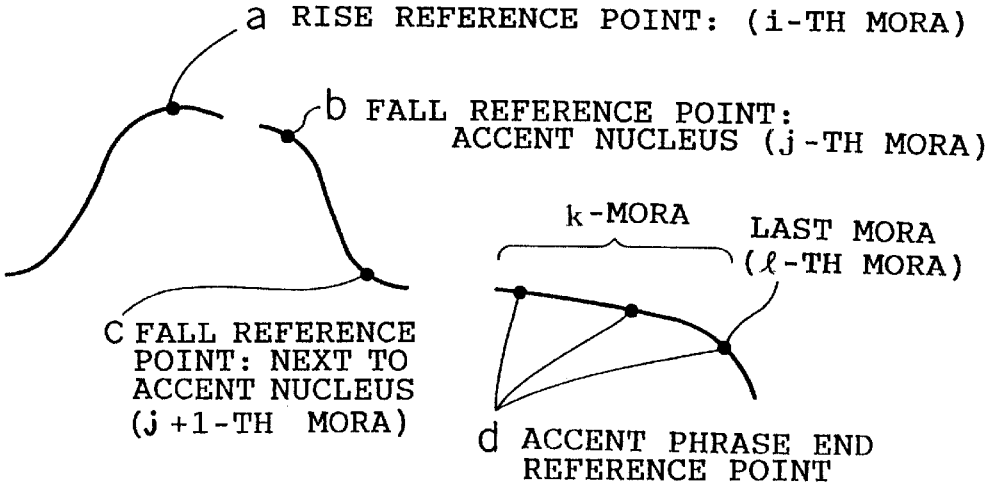
FIGS. 12(A) and 12(B) are view showing an example of the fundamental frequency pattern according to the present invention.
Figure 12B:
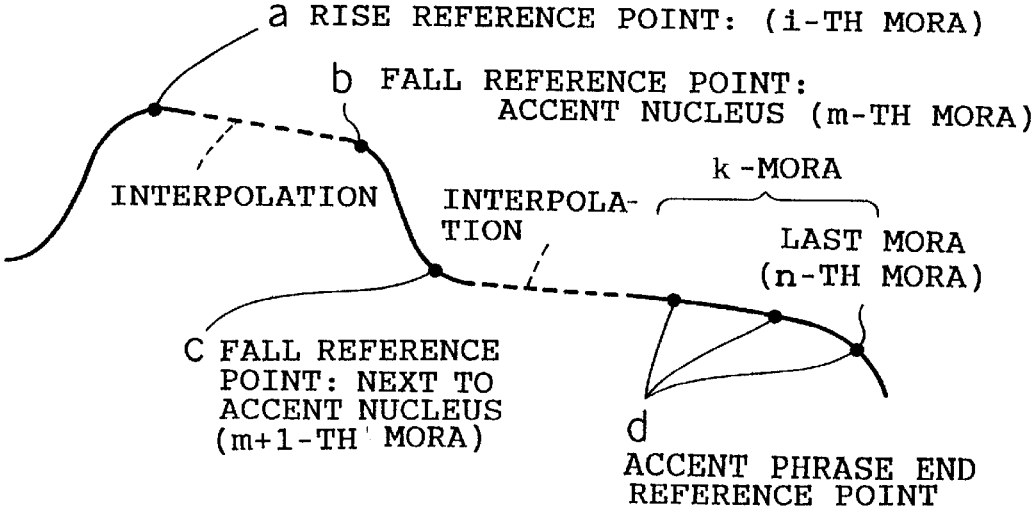

When m exceeds i+1 and is not more than n−k, as shown in FIG. 12 (A), a) to d) of a fundamental frequency pattern of l-mora j type in which the mora position j of the accent nucleus exceeds i+1 and is not more than l−k and the number of morae is closest to n are obtained from the phoneme time length standardized fundamental frequency data base 351, and as shown in FIG. 12(B), b) and c) obtained from the phoneme time length standardized fundamental frequency data base 351 are set as the reference points of the m-th mora and the m+1-th mora of the accent phrase for which the fundamental frequency is to be generated and d) obtained from the phoneme time length standardized fundamental frequency data base 351 is set as the reference point of the n−k+1th mora to the n-th mora of the accent phrase for which the fundamental frequency is to be generated.

Figure 13A:
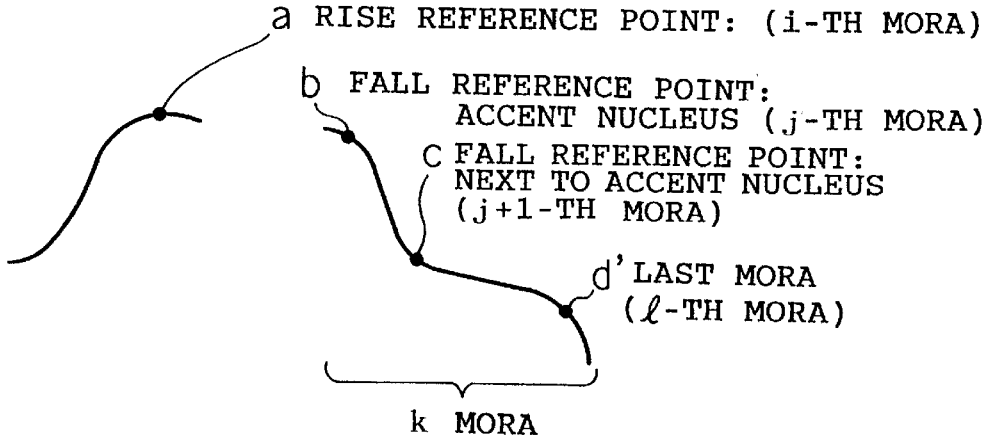
FIGS. 13(A) and 13(B) are view showing an example of the fundamental frequency pattern according to the present invention.
Figure 13B:
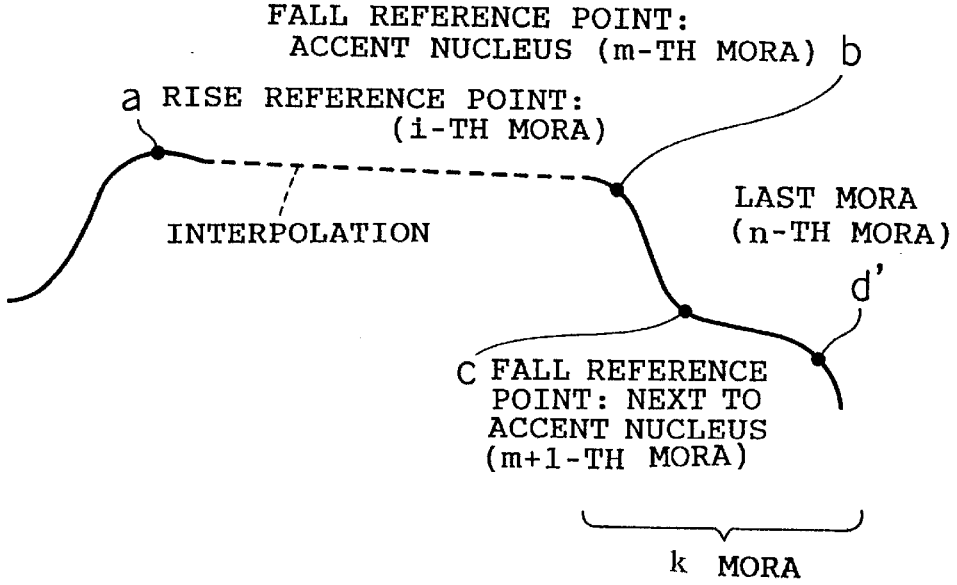

When m exceeds n-k, as shown in FIG. 13(A), a) to d') of a fundamental frequency pattern of 1-mora j type in which the mora position j of the accent nucleus exceeds 1−k and the number of morae is closest to n are obtained from the phoneme time length standardized fundamental frequency data base 351, and as shown in FIG. 13(B), d') including b) and c) obtained from the phoneme time length standardized fundamental frequency data base 351 is set as the reference points of the n−k+1-th mora to the n—th mora of the accent phrase for which the fundamental frequency is to be generated. When the accent phrase for which the fundamental frequency is to be generated is of n-mora flat type, as shown in FIG. 14(A), a) and d) of a fundamental frequency pattern of l-mora flat type in which the accent type is the flat type and the number of morae is closest to n are obtained from the phoneme time length standardized fundamental frequency data base 351, and as shown in FIG. 13(B), d) obtained from the phoneme time length standardized fundamental frequency data base 351 is set as the reference points of the n−k+1-th mora to the n-th mora of the accent phrase for which the fundamental frequency is to be generated.

Then, the maximum value of the fundamental frequency of each accent phrase and the fundamental frequencies of the reference points of a) to d) or d') are changed in accordance with a variation amount in which the fundamental frequency pattern of the accent phrase obtained from the phoneme time length standardized fundamental frequency data base 351 or generated from the reference points obtained from the phoneme time length standardized fundamental frequency data base 351 is stored for the position of each accent phrase in the sentence phrase.

First, based on the variation amount of the first accent phrase stored in the fundamental frequency variation data base 350, as shown at (A) in FIG. 15, the fundamental frequencies of b), c) and d) are changed so that the fundamental frequency difference between a) and d) is 90% of the fundamental frequency difference obtained from the phoneme time length standardized fundamental frequency data base 351. For the second accent phrase, as shown at (B) in FIG. 15, the fundamental frequency of a) is changed to a value which is 75% of the fundamental frequency obtained from the phoneme time length standardized fundamental frequency data base 351, and the fundamental frequencies of b), c) and d) are changed so that the fundamental frequency difference between a) and d) is 70% of the fundamental frequency difference obtained from the phoneme time length standardized fundamental frequency data base 351. Likewise, for the third accent phrase, as shown at (C) in FIG. 15, the fundamental frequency of a) is changed to a value which is 70% of the fundamental frequency obtained from the phoneme time length standardized fundamental frequency data base 351, and the fundamental frequencies of b), c) and d) are changed so that the fundamental frequency difference between a) and d) is 68% of the fundamental frequency difference obtained from the phoneme time length standardized fundamental frequency data base 351.

When the variation amount corresponding to the n-th accent phrase is not stored in the fundamental frequency variation data base 350, the variation amount is applied corresponding to the accent position whose value is lower than n and closest to n. In this embodiment, a case is shown in which the variation amount of the fourth accent phrase is not stored in the fundamental frequency variation data base 350.

Applying the variation amount of the third accent phrase in which the value of the accent position is lower than 4 and closest to 4, changes similar to those made in the third accent phrase are made as shown at (D) in FIG. 15. For the last accent phrase which is the end of the phrase, the variation amount corresponding to the last accent phrase is obtained from the fundamental frequency variation data base 350, and as shown at (E) in FIG. 15, the fundamental frequency of a) is changed to a value which is 48% of the fundamental frequency obtained from the phoneme time length standardized fundamental frequency data base 351 and the fundamental frequencies of b), c) and d) are changed so that the fundamental frequency difference between a) and d) is 60% of the fundamental frequency difference obtained from the phoneme time length standardized fundamental frequency data base 351.

Then, for each accent phrase, the fundamental frequency from the head of the accent phrase to a) is generated by use of a function on the real time axis like in the second or the fourth embodiment, and the interval of each two of the reference points is interpolated on the real time axis to generate the fundamental frequency pattern up to the end of the accent phrase.

The voice cord vibration generating portion 70 generates voice cord vibrations of the synthesized speech in accordance with the fundamental frequency pattern output from the fundamental frequency pattern generating portion 60.

By setting the timing of the rise of the accent phrase and the fall at the accent nucleus which timing largely affects the naturalness of speech on the time axis standardized by the phoneme length of the mora concerned, a smooth fundamental frequency pattern can be obtained in which the rise and the fall are stable without being affected by the time length difference due to the phonological segment, so that high naturalness is realized. Further, by expanding the fundamental frequency pattern, the data base size can be reduced. Moreover, by changing the fundamental frequency pattern based on the position of the accent phrase in the sentence phrase, the unity as a phrase is formed, so that natural sentence speech can be realized.

Seventh Embodiment

Figure 17A:
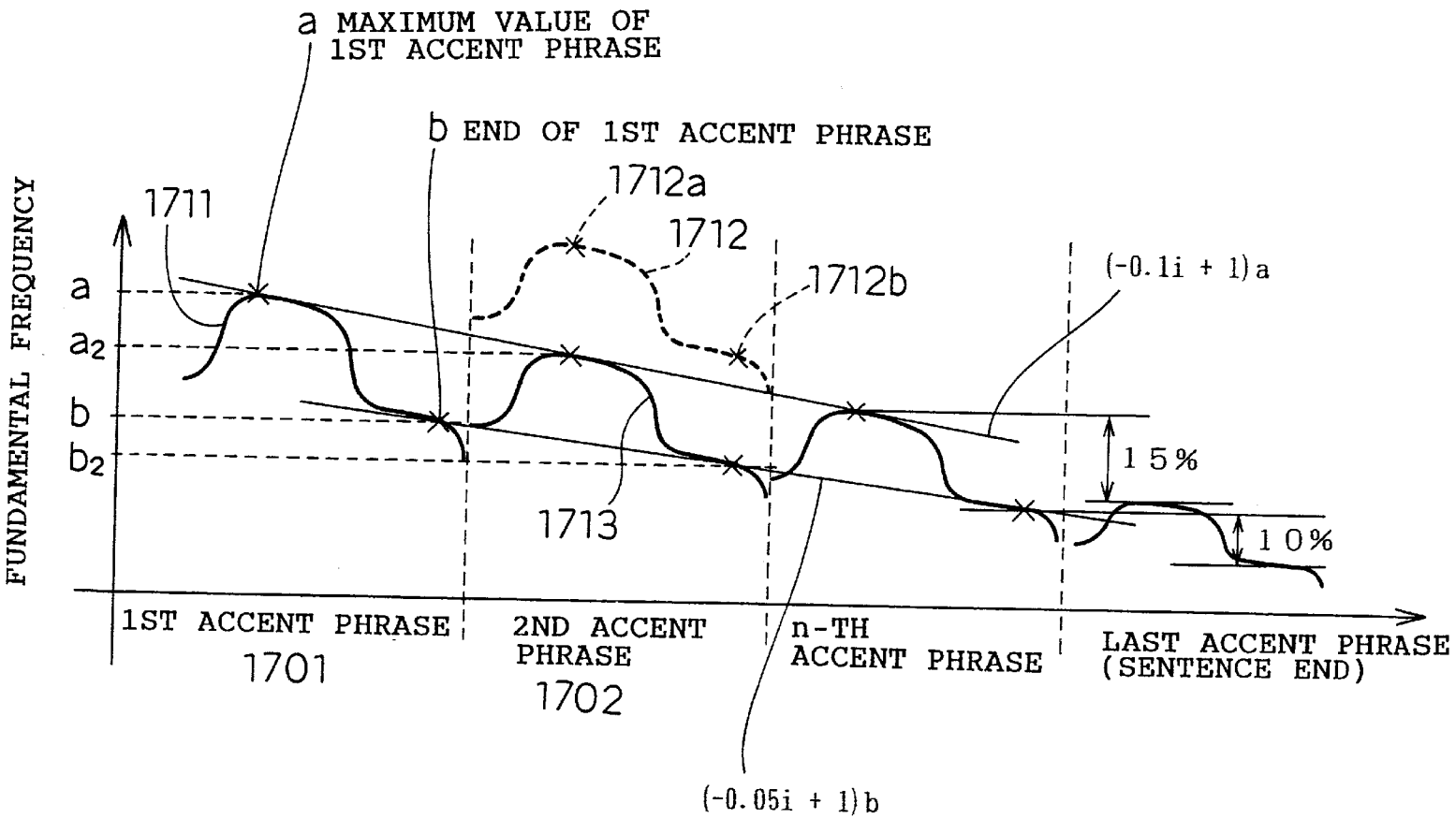
FIGS. 17(A) and 17(B) are schematic view of the fundamental frequency pattern according to the present invention.

FIG. 17(A) is a schematic view of a fundamental frequency pattern of a sentence generated by connecting the fundamental frequency patterns of a plurality of accent phrases. The apparatus structure is the same as that of FIG. 1. The operation thereof will hereinafter be described.

First, a character string to be converted into speech is input from the character string input portion 10. The character string analyzing portion 20 analyzes the input character string, outputs phonological segment information representative of a phoneme string to the time length setting portion 40, divides the character string into accent phrases, and outputs rhythm information representative of the number of morae and the accent type of each accent phrase and the phonological segment information representative of the phoneme string to the fundamental frequency pattern generating portion 60. The time length setting portion 40 sets the time length of each phoneme with reference to the phonological segment time length data base 30 based on the phonological segment information input from the character string analyzing portion 20, and outputs time length information to the fundamental frequency pattern generating portion 60. The fundamental frequency pattern generating portion 60 generates the fundamental frequency pattern for each accent phrase based on the rhythm information and the phonological segment information input from the character string analyzing portion 20 and the time length information input from the time length setting portion 40.

As shown in FIG. 17(A), first, a fundamental frequency pattern 1711 corresponding to the number of morae and the accent type of the first accent phrase 1701 is obtained from the mora time length standardized fundamental frequency data base 50, and the obtained fundamental frequency pattern 1711 is applied.

An expression 1 is obtained that represents the maximum value of a fundamental frequency of an accent phrase for the n-th accent phrase which fundamental frequency passes the maximum value a of the fundamental frequency of the first accent phrase 1701 and such that the maximum value a decreases 10% every time the value of i representative of the position of the n-th accent phrase increases.

$$(-0.1i+1)a \qquad \text{expression 1}$$

Here, a is the maximum value of the fundamental frequency of the first accent phrase 1701. The accent phrase number i, which is a value representative of where the n-th accent phrase is from the first accent phrase, is n−1.

Further, an expression 2 is obtained that represents the frequency of the accent phrase end for the n-th accent phrase which frequency passes the frequency b of the accent phrase end of the first accent phrase 1701 and such that the frequency b of the accent phrase end of the first accent phrase 1701 decreases 5% every time the value of i representative of the position of the n-th accent phrase increases.

$$(-0.05i+1)b \qquad \text{expression 2}$$

Here, b is the frequency of the accent phrase end of the first accent phrase 1701.

Then, a fundamental frequency pattern 1712 (shown by the dotted line in the figure) corresponding to the number of morae and the accent type of the second accent phrase 1702 is obtained from the mora time length standardized fundamental frequency data base 50. Since the accent phrase number i of the second accent phrase is 1, 1 is substituted into the expression 1 to obtain the after-change maximum value $a_2$ of the fundamental frequency pattern 1712. Likewise, the after-change frequency $b_2$of the accent phrase end of the fundamental frequency pattern 1712 is obtained from the expression 2.

After the fundamental frequency pattern 1712 obtained from the mora time length standardized fundamental frequency data base 50 is changed so as to coincide with the after-change maximum value $a_2$ and the after-change frequency $b_2$ of the accent phrase end thus obtained, the after-change fundamental frequency pattern 1713 is used as the fundamental frequency pattern of the second accent phrase 1702.

For the n-th accent phrase, when the accent phrase concerned is not the last accent phrase (sentence end), the fundamental frequency pattern corresponding to the number of morae and the accent type of the n-th accent phrase is obtained from the mora time length standardized fundamental frequency data base 50. Then, the fundamental frequency pattern obtained from the data base 50 is changed so that the maximum value of the obtained fundamental frequency pattern coincides with the value obtained from the expression 1 and the accent phrase end frequency of the obtained fundamental frequency pattern coincides with the value obtained from the expression 2, and the changed fundamental frequency pattern is used as the fundamental frequency pattern of the n-th accent phrase.

Further, when the accent phrase for which the fundamental frequency is to be generated is the sentence end, the fundamental frequency pattern corresponding to the number of morae and the accent type is obtained from the mora time length standardized fundamental frequency data base 50. Then, the fundamental frequency pattern obtained from the data base 50 is changed so that the maximum value thereof coincides with a value which is 15% lower than the maximum value of the accent phrase immediately before the accent phrase concerned and that the frequency of the accent phrase end coincides with a value which is 10% lower than the accent phrase end of the accent phrase immediately before the accent phrase concerned, and the changed fundamental frequency pattern is applied. When the data of the corresponding fundamental frequency pattern are not stored in the mora time length standardized fundamental frequency data base 50, the fundamental frequency pattern of the accent phrase is generated like in the sixth embodiment and the generated fundamental frequency pattern is changed.

The voice cord vibration generating portion 70 generates voice cord vibrations of the synthesized speech in accordance with the fundamental frequency pattern output from the fundamental frequency pattern generating portion 60.

By setting on the time axis standardized by the time length of the mora concerned, a smooth fundamental frequency pattern can be obtained in which the rise and the fall are stable without being affected by the time length difference due to the phonological segment, so that high naturalness is realized. Moreover, by changing the fundamental frequency pattern based on the position of the accent phrase in the sentence phrase, the unity as a phrase is formed, so that natural sentence speech can be realized.

Figure 17B:
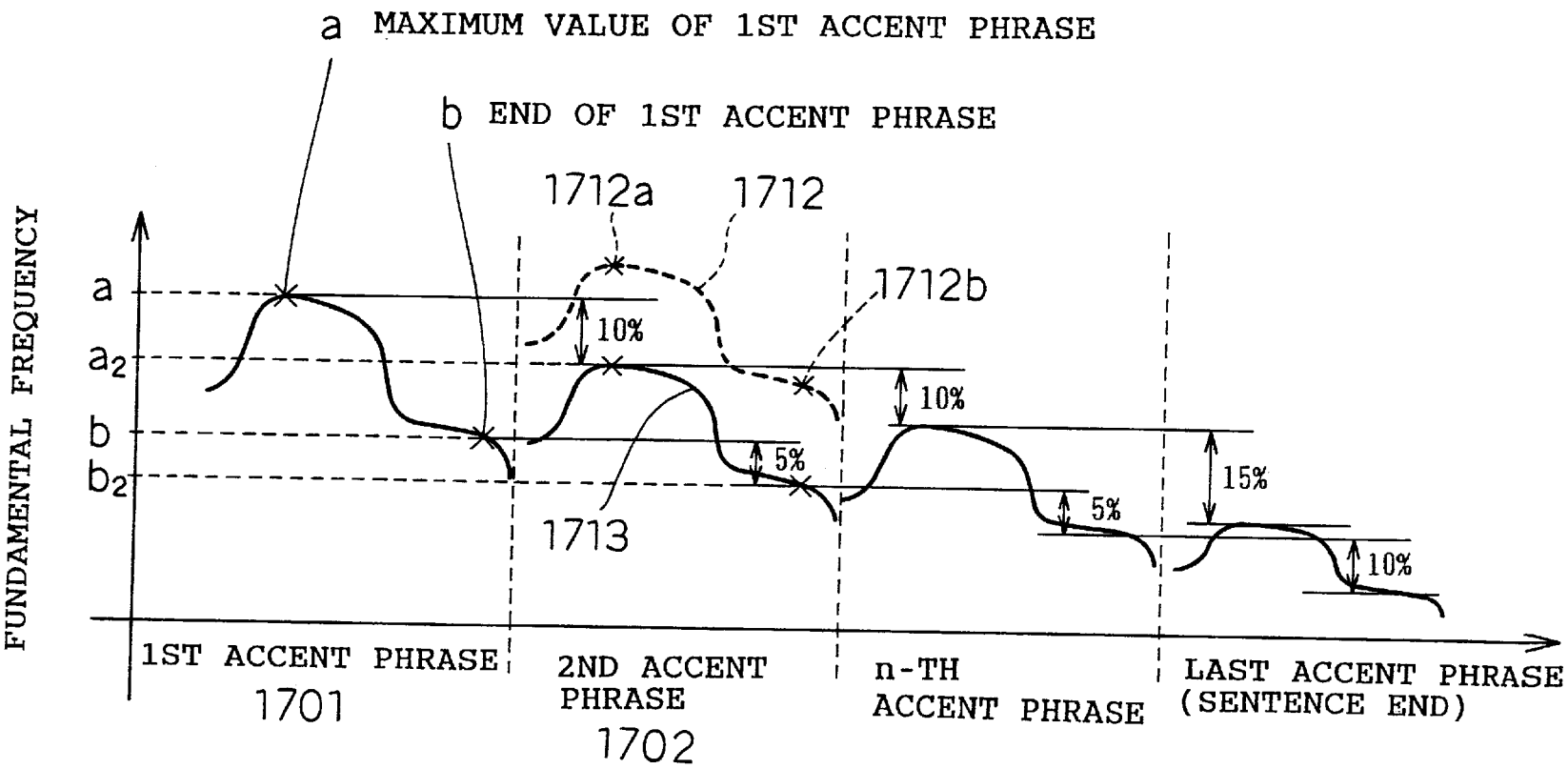

In the above-described embodiment, only when the accent phrase for which the fundamental frequency is to be generated is at the end of the sentence, using the frequency of a predetermined position of the accent phrase immediately therebefore as the reference, the frequency is reduced by a predetermined ratio and the reduced frequency is used. As a modification of the above-described embodiment, for the accent phrases existing at positions other than the end of the sentence, the frequencies thereof may be compressed by the same rule as that of the above-described embodiment. That is, in this modification, for example, as shown in FIG. 17(B), for the second accent phrase to the n-th accent phrase except the accent phrase at the end of the sentence, the following values are obtained for each of them: a value which is 10% lower than the maximum value of the accent phrase immediately therebefore (for example, $a_2$in the figure); and a value which is 5% lower than the accent phrase end frequency of the accent phrase immediately therebefore (for example, $b_2$ in the figure).

Then, for example, for the second accent phrase, after the fundamental frequency pattern 1712 obtained from the mora time length standardized fundamental frequency data base 50 is changed so as to coincide with the after-change maximum value $a_2$ and the after-change frequency $b_2$ of the accent phrase end thus obtained, the after-change fundamental frequency pattern 1713 is used as the fundamental frequency pattern of the second accent phrase 1702. This applies to the n-th accent phrase. When the accent phrase for which the fundamental frequency is to be generated is the end of the sentence, a method similar to that of FIG. 17(A) is used.

Eighth Embodiment

Figure 18:
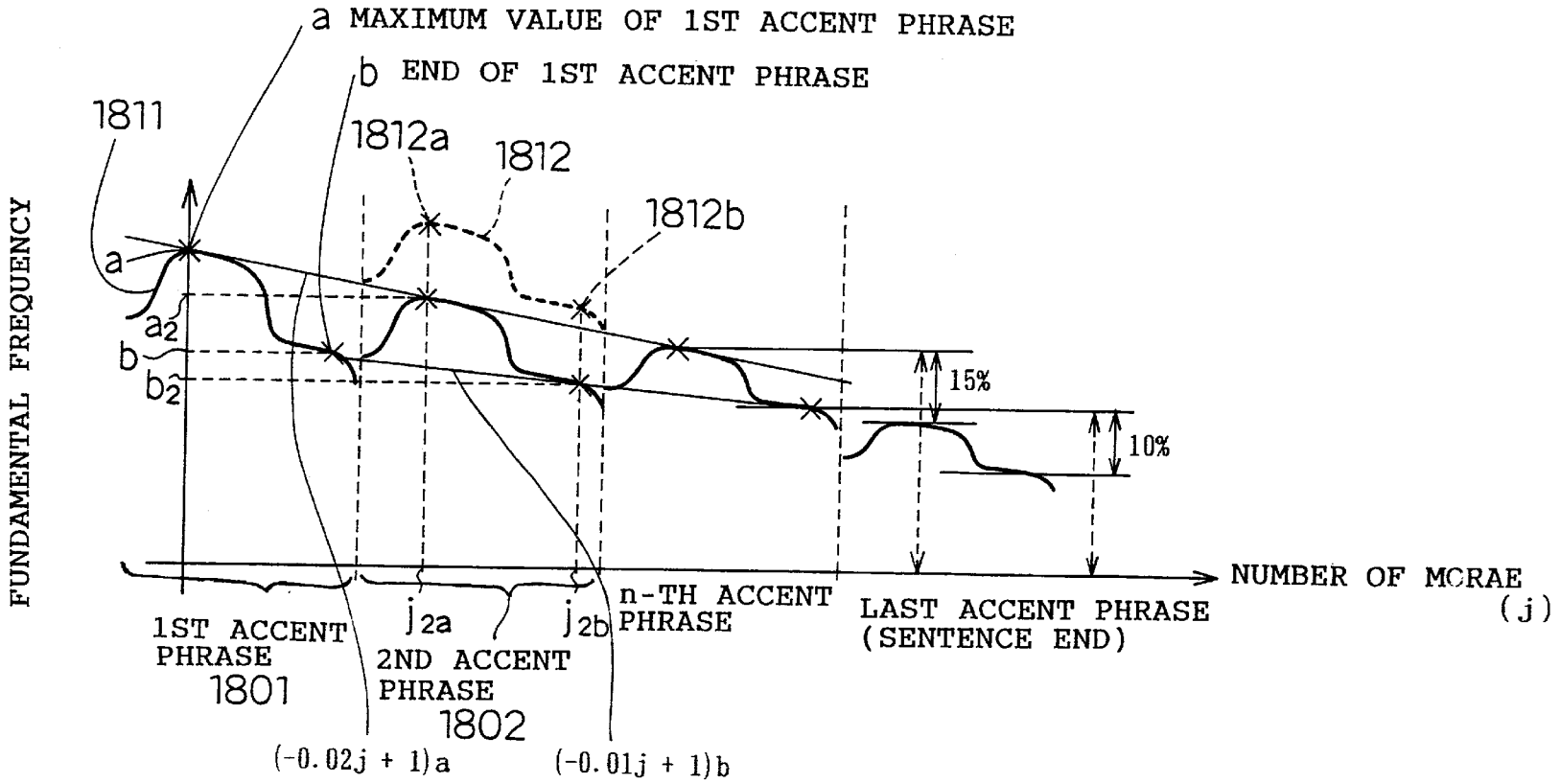
FIG. 18 is a schematic view of the fundamental frequency pattern according to the present invention.

FIG. 18 is a schematic view of a fundamental frequency pattern of a sentence generated by connecting the fundamental frequency patterns of a plurality of accent phrases. The apparatus structure is the same as that of FIG. 1. The operation thereof will hereinafter be described.

First, a character string to be converted into speech is input from the character string input portion 10. The character string analyzing portion 20 analyzes the input character string, outputs phonological segment information representative of a phoneme string to the time length setting portion 40, divides the character string into accent phrases, and outputs rhythm information representative of the number of morae and the accent type of each accent phrase and the phonological segment information representative of the phoneme string to the fundamental frequency pattern generating portion 60. The time length setting portion 40 sets the time length of each phoneme with reference to the phonological segment time length data base 30 based on the phonological segment information input from the character string analyzing portion 20, and outputs time length information to the fundamental frequency pattern generating portion 60. The fundamental frequency pattern generating portion 60 generates the fundamental frequency pattern for each accent phrase based on the rhythm information and the phonological segment information input from the character string analyzing portion 20 and the time length information input from the time length setting portion 40.

As shown in FIG. 18, first, a fundamental frequency pattern 1811 corresponding to the number of morae and the accent type of the first accent phrase 1801 is obtained from the mora time length standardized fundamental frequency data base 50, and the obtained fundamental frequency pattern 1811 is applied.

An expression 3 is obtained that represents the maximum value of the fundamental frequency of the accent phrase for the cumulative mora number j which fundamental frequency passes the maximum value a of the fundamental frequency of the first accent phrase 1801 and such that the maximum value a of the accent phrase 1801 decreases 2% every time the number of morae from the mora position including the maximum value a of the fundamental frequency of the first accent phrase increases.

$$(-0.02j+1)a \qquad \text{expression 3}$$

Here, a is the maximum value of the fundamental frequency of the first accent phrase 1801, and the cumulative mora number j is the number of morae counted using as the reference the mora position (the origin of the horizontal axis in the figure) including the maximum value a of the fundamental frequency of the first accent phrase.

Further, an expression 4 is obtained that represents the frequency of the accent phrase end for the cumulative mora number j which frequency passes the frequency b of the accent phrase end of the first accent phrase 1801 and such that the frequency b of the accent phrase end of the first accent phrase 1801 decreases 1% every time the number of morae from the mora position including the frequency b of the accent phrase end of the first accent phrase increases.

$$(-0.01j+1)b \qquad \text{expression 4}$$

Here, b is the frequency of the accent phrase end of the first accent phrase 1801.

Then, a fundamental frequency pattern 1812 (shown by the dotted line in the figure) corresponding to the number of morae and the accent type of the second accent phrase 1802 is obtained from the mora time length standardized fundamental frequency data base 50. Then, it is obtained that the mora that takes the maximum value 1812*a* thereof is the $j2_a$-th mora from the origin mora, and this is substituted into the expression 3 as the cumulative mora number to obtain the after-change maximum value $a_2$ of the fundamental frequency pattern 1812. Moreover, it is obtained that an accent phrase end 1812*b* of the second accent phrase 1802 is the $j2_b$-th mora from the origin mora, and this is substituted into the expression 4 to obtain the after-change frequency $b_2$ of the accent phrase end of the fundamental frequency pattern 1812.

After the fundamental frequency pattern 1812 obtained from the mora time length standardized fundamental frequency data base 50 is changed so as to coincide with the after-change maximum value $a_2$ and the after-change frequency $b_2$ of the accent phrase end thus obtained, the changed fundamental frequency pattern is used as the fundamental frequency pattern of the second accent phrase 1802.

For the n-th accent phrase, when the accent phrase concerned is not the last accent phrase (sentence end), the fundamental frequency pattern corresponding to the number of morae and the accent type of the n-th accent phrase is obtained from the mora time length standardized fundamental frequency data base 50. Then, it is obtained where the mora that takes the maximum value is from the origin mora, and this is substituted into the expression 3 as the cumulative mora number to obtain the after-change maximum value of the fundamental frequency pattern. Further, it is obtained where the accent phrase end is from the origin mora, and this is substituted into the expression 4 as the cumulative mora number to obtain the after-change frequency of the accent phrase end of the fundamental frequency pattern.

The fundamental frequency pattern obtained from the mora time length standardized fundamental frequency data base 50 is changed so as to coincide with the after-change maximum value and the after-change frequency of the accent phrase end thus obtained, and the changed fundamental frequency pattern is used as the fundamental frequency pattern of the n-th accent phrase. When the accent phrase for which the fundamental frequency is to be generated is at the end of the sentence, the fundamental frequency pattern corresponding to the number of morae and the accent type is obtained from the mora time length standardized fundamental frequency data base 50. Then, the obtained fundamental frequency pattern is changed so that the maximum value thereof coincides with a value which is 15% lower than the maximum value of the accent phrase immediately before the accent phrase concerned and that the frequency of the accent phrase end coincides with a value which is 10% lower than the frequency of the accent phrase end immediately before the accent phrase concerned, and the changed fundamental frequency pattern is applied. When the data of the corresponding fundamental frequency pattern are not stored in the mora time length standardized fundamental frequency data base 50, the fundamental frequency pattern of the accent phrase is generated like in the sixth embodiment and the changed fundamental frequency pattern is changed.

The voice cord vibration generating portion 70 generates voice cord vibrations of the synthesized speech in accordance with the fundamental frequency pattern output from the fundamental frequency pattern generating portion 60.

By setting on the time axis standardized by the time length of the mora concerned, a smooth fundamental frequency pattern can be obtained in which the rise and the fall are stable without being affected by the time length difference due to the phonological segment, so that high naturalness is realized. Moreover, by changing the fundamental frequency pattern based on the cumulative mora position in the sentence phrase, the unity as a phrase is formed, so that natural sentence speech can be realized.

Ninth Embodiment

Figure 16:
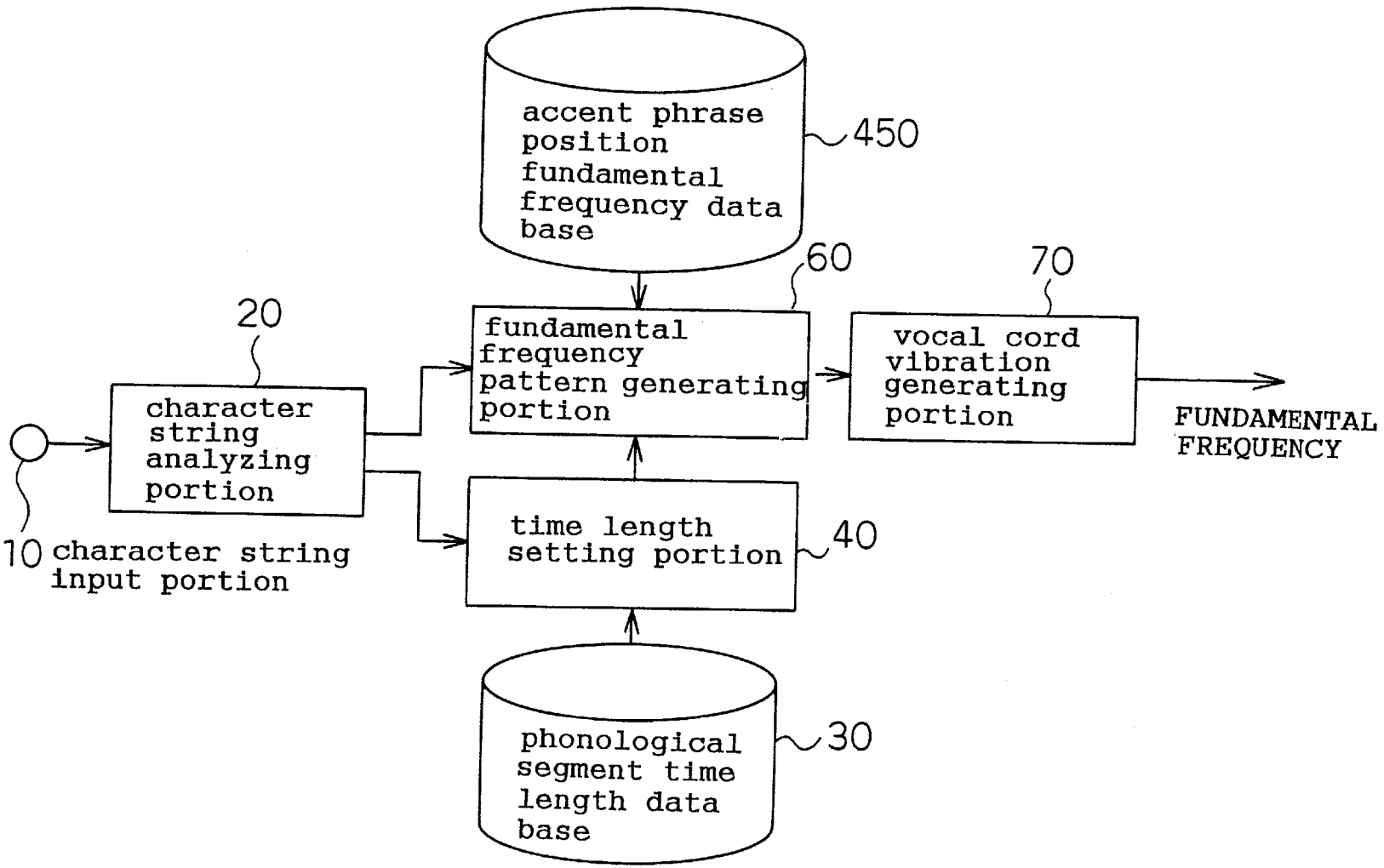
FIG. 16 is a function block diagram of an apparatus showing an embodiment of the present invention.

FIG. 16 is a function block diagram of an apparatus showing an embodiment of the present invention. FIG. 16 is the same as FIG. 1 except that the mora time length standardized fundamental frequency data base 50 is replaced by an accent phrase position fundamental frequency data base 450 that stores the fundamental frequency pattern of the vowel portion of each mora standardized by the time length of the vowel portion of each mora which fundamental frequency pattern is classified according to whether the accent phrase is at the end of a sentence or not and to factors that decide the rhythm such as the number of morae, the accent type and the phonological segment string of the accent phrase with respect to the first to the third accent phrases.

The operation of the fundamental frequency pattern generator structured as described above will hereinafter be described.

First, a character string to be converted into speech is input from the character string input portion 10. The character string analyzing portion 20 analyzes the input character string, outputs phonological segment information representative of a phoneme string to the time length setting portion 40, divides the character string into accent phrases, and outputs rhythm information representative of the number of morae and the accent type of each accent phrase and the position of each accent phrase in the sentence phrase, and the phonological segment information representative of the phoneme string to the fundamental frequency pattern generating portion 60.

The time length setting portion 40 sets the vowel time length of each mora or the time length of the vowel corresponding portion in the monophthong syllable, in the syllabic nasal or in the long vowel with reference to the phonological segment time length data base 30 based on the phonological segment information input from the character string analyzing portion 20, and outputs time length information to the fundamental frequency pattern generating portion 60. The fundamental frequency pattern generating portion 60 generates the fundamental frequency pattern for each accent phrase based on the rhythm information and the phonological segment information input from the character string analyzing portion 20 and the time length information input from the time length setting portion 40. In this embodiment, the generation of the fundamental frequency of a sentence comprising five accent phrases will be described.

First, for the first accent phrase, the fundamental frequency pattern corresponding to the number of morae and the accent type of the accent phrase for which the fundamental frequency is to be generated which accent phrase is the first accent phrase and is not at the end of the sentence is obtained from the accent phrase position fundamental frequency data base 450. Likewise, for each of the second accent phrase and the third accent phrase, the fundamental frequency pattern is obtained from the accent phrase position fundamental frequency data base 450.

For the fourth accent phrase, since the fundamental frequency pattern corresponding to the fourth accent phrase is not stored in the accent phrase position fundamental frequency data base 450, a fundamental frequency pattern corresponding to the number of morae and the accent type is obtained from the fundamental frequency pattern of the third accent phrase whose position is closest to the fourth accent phrase which fundamental frequency pattern does not correspond to the end of the sentence.

For the fifth accent phrase which is the last accent phrase, since the corresponding fundamental frequency pattern is not stored in the accent phrase position fundamental frequency data base 450, a fundamental frequency pattern corresponding to the number of morae and the accent type is obtained from the fundamental frequency pattern of the third accent phrase whose position is closest which fundamental frequency pattern corresponds to the end of the sentence. Like in the third or the fourth embodiment, the portions of which fundamental frequency patterns are absent are interpolated on the real time axis to generate a fundamental frequency pattern.

The voice cord vibration generating portion 70 generates voice cord vibrations of the synthesized speech in accordance with the fundamental frequency pattern output from the fundamental frequency pattern generating portion 60.

By using the fundamental frequency pattern standardized by the vowel length of the mora concerned, variation in fundamental frequency in the mora is reproduced in detail, and by applying according to the position of the accent phrase and the condition as to whether the accent phrase is situated at the end of the sentence or not, variation in fundamental frequency for each sentence phrase can be reproduced with accuracy, so that the unity as a phrase is formed. As a result, natural sentence speech can be realized.

Tenth Embodiment

Figure 19:
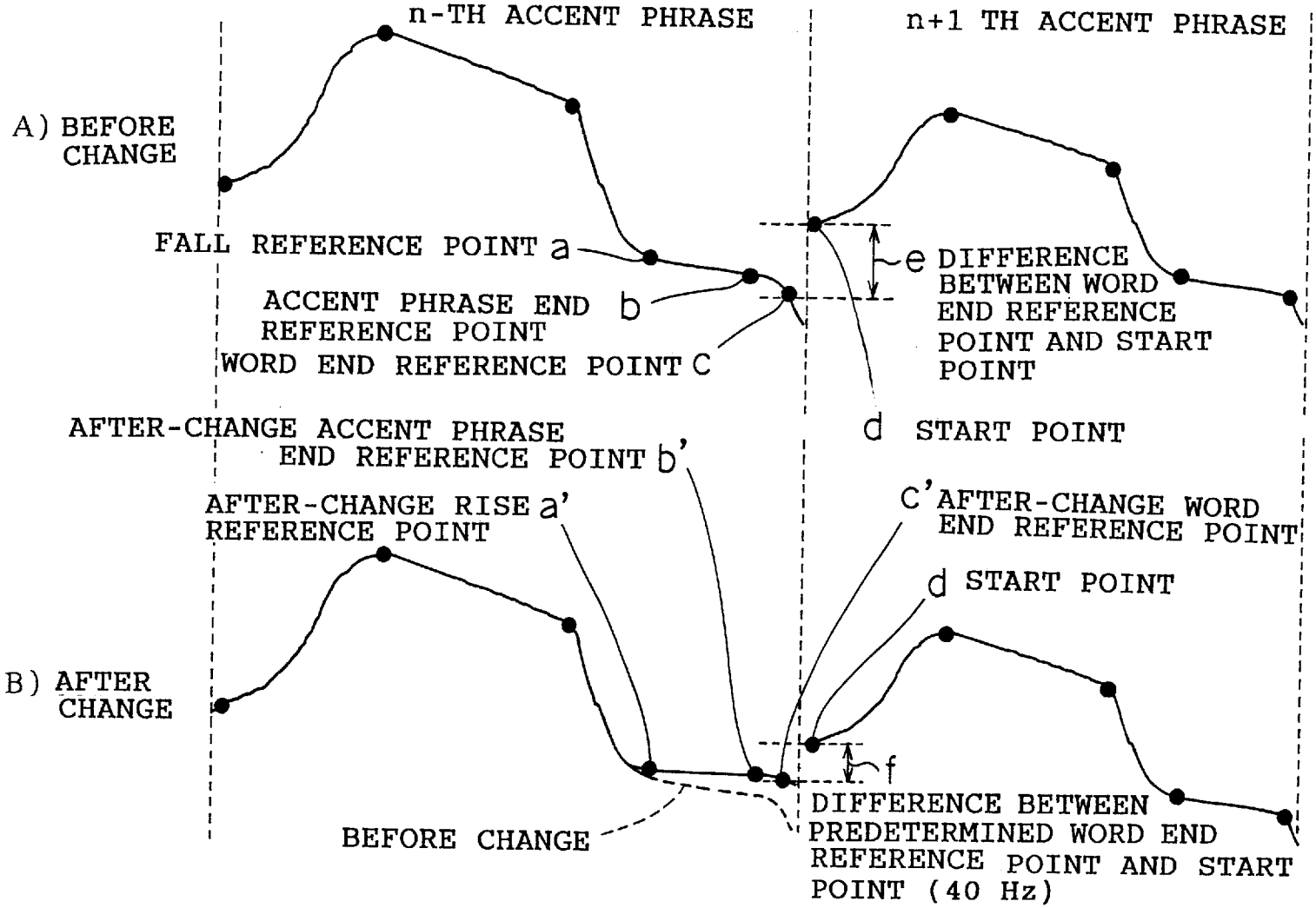
FIG. 19 is a schematic view of accent phrase connected portions of the fundamental frequency pattern of the present invention.

FIG. 19 is a schematic view of fundamental frequency pattern connected portions when the fundamental frequency patterns of accent phrases are connected to generate a sentence. The structure of the apparatus is the same as FIG. 1. The operation thereof will hereinafter be described.

First, a character string to be converted into speech is input from the character string input portion 10. The character string analyzing portion 20 analyzes the input character string, outputs phonological segment information representative of a phoneme string to the time length setting portion 40, divides the character string into accent phrases, and outputs rhythm information representative of the number of morae and the accent type of each accent phrase and the phonological segment information representative of the phoneme string to the fundamental frequency pattern generating portion 60. The time length setting portion 40 sets the time length of each phoneme with reference to the phonological segment time length data base 30 based on the phonological segment information input from the character string analyzing portion 20, and outputs time length information to the fundamental frequency pattern generating portion 60. The fundamental frequency pattern generating portion 60 generates the fundamental frequency pattern for each accent phrase based on the rhythm information and the phonological segment information input from the character string analyzing portion 20 and the time length information input from the time length setting portion 40.

First, the fundamental frequency pattern corresponding to the number of morae and the accent type of each accent phrase for which the fundamental frequency pattern is to be generated is obtained from the mora time length standardized fundamental frequency data base 50 and the obtained fundamental frequency pattern is applied. By the method of the sixth, the seventh or the eighth embodiment, the fundamental frequency pattern obtained from the mora time length standardized fundamental frequency data base 50 is changed for each accent phrase.

Of the changed frequency patterns of the accent phrases, for the n-th accent phrase that is not at the end of the sentence, the difference shown ate) in FIG. 19 between the fundamental frequency of the vowel portion of the last mora of the accent phrase concerned and the fundamental frequency of the vowel portion of the first mora of the n+1-th accent phrase is obtained.

When there is no pause between the n-th accent phrase and the n+1-th accent phrase, the difference shown at e) between the fundamental frequency of the vowel portion of the last mora of the accent phrase concerned and the fundamental frequency of the vowel portion of the first mora of the n+1-th accent phrase is not less than 40 Hz. When the accent nucleus of the n-th accent phrase is not included in the last three morae of the accent phrase, the fundamental frequency pattern from a mora which is the first mora of the accent phrase end reference point or a mora preceding the accent phrase end reference point and that has a fundamental frequency exceeding a value obtained by subtracting 40 from the fundamental frequency of the vowel portion of the first mora of the n+1-th accent phrase, and to the last mora of the n-th accent phrase is compressed in the direction of the frequency axis, thereby smoothly connecting the n-th accent phrase and the n+1-th accent phrase as shown at f) in FIG. 19. When the difference shown at e) between the fundamental frequency of the vowel portion of the last mora of the accent phrase concerned and the fundamental frequency of the vowel portion of the first mora of the n+1-th accent phrase is not less than 40 Hz and the accent nucleus of the n-th accent phrase is included in the last three morae in the accent phrase, the fundamental frequency pattern from a mora which is the mora of the accent nucleus or a mora preceding the accent nucleus and that has a fundamental frequency exceeding a value obtained by subtracting 40 from the fundamental frequency of the vowel portion of the first mora of the n+1-th accent phrase, and to the last mora of the n-th accent phrase is compressed in the direction of the frequency axis, thereby smoothly connecting the n-th accent phrase and the n+1-th accent phrase.

In a case where there is a pause of less than 50 msec between the n-th accent phrase and the n+1-th accent phrase, when the difference shown at e) between the fundamental frequency of the vowel portion of the last mora of the accent phrase concerned and the fundamental frequency of the vowel portion of the first mora of the n+1-th accent phrase is not less than 50 Hz and the accent nucleus of the n-th accent phrase is not included in the last three morae in the accent phrase, the fundamental frequency pattern from a mora which is the first mora of the accent phrase end reference point or a mora preceding the accent phrase end reference point and that has a fundamental frequency exceeding a value obtained by subtracting 50 from the fundamental frequency of the vowel portion of the first mora of the n+1-th accent phrase, and to the last mora of the n-th accent phrase is compressed in the direction of the frequency axis. When the difference shown at e) between the fundamental frequency of the vowel portion of the last mora of the accent phrase concerned and the fundamental frequency of the vowel portion of the first mora of the n+1-th accent phrase is not less than 50 Hz and the accent nucleus of the n-th accent phrase is included in the last three morae in the accent phrase, the fundamental frequency pattern from a mora which is the mora of the accent nucleus or a mora preceding the accent nucleus and that has a fundamental frequency exceeding a value obtained by subtracting 50 from the fundamental frequency of the vowel portion of the first mora of the n+1-th accent phrase, and to the last mora of the n-th accent phrase is compressed in the direction of the frequency axis.

In a case where there is a pause of not less than 50 msec and less than 100 msec between the n-th accent phrase and the n+1-th accent phrase, when the difference shown at e) between the fundamental frequency of the vowel portion of the last mora of the accent phrase concerned and the fundamental frequency of the vowel portion of the first mora of the n+1-th accent phrase is not less than 70 Hz and the accent nucleus of the n-th accent phrase is not included in the last three morae in the accent phrase, the fundamental frequency pattern from a mora which is the first mora of the accent phrase end reference point or a mora preceding the accent phrase end reference point and that has a fundamental frequency exceeding a value obtained by subtracting 70 from the fundamental frequency of the vowel portion of the first mora of the n+1-th accent phrase, and to the last mora of the n-th accent phrase is compressed in the direction of the frequency axis. When the difference shown at e) between the fundamental frequency of the vowel portion of the last mora of the accent phrase concerned and the fundamental frequency of the vowel portion of the first mora of the n+1-th accent phrase is not less than 70 Hz and the accent nucleus of the n-th accent phrase is included in the last three morae in the accent phrase, the fundamental frequency pattern from a mora which is the mora of the accent nucleus or a mora preceding the accent nucleus and that has a fundamental frequency exceeding a value obtained by subtracting 70 from the fundamental frequency of the vowel portion of the first mora of the n+1-th accent phrase, and to the last mora of the n-th accent phrase is compressed in the direction of the frequency axis.

In a case where there is a pause of not less than 100 msec and less than 150 msec between the n-th accent phrase and the n+1-th accent phrase, when the difference shown at e) between the fundamental frequency of the vowel portion of the last mora of the accent phrase concerned and the fundamental frequency of the vowel portion of the first mora of the n+1-th accent phrase is not less than 80 Hz and the accent nucleus of the n-th accent phrase is not included in the last three morae in the accent phrase, the fundamental frequency pattern from a mora which is the first mora of the accent phrase end reference point or a mora preceding the accent phrase end reference point and that has a fundamental frequency exceeding a value obtained by subtracting 80 from the fundamental frequency of the vowel portion of the first mora of the n+1-th accent phrase, and to the last mora of the n-th accent phrase is compressed in the direction of the frequency axis. When the difference shown at e) between the fundamental frequency of the vowel portion of the last mora of the accent phrase concerned and the fundamental frequency of the vowel portion of the first mora of the n+1-th accent phrase is not less than 80 Hz and the accent nucleus of the n-th accent phrase is included in the last three morae in the accent phrase, the fundamental frequency pattern from a mora which is the mora of the accent nucleus or a mora preceding the accent nucleus and that has a fundamental frequency exceeding a value obtained by subtracting 70 from the fundamental frequency of the vowel portion of the first mora of the n+1-th accent phrase, and to the last mora of the n-th accent phrase is compressed in the direction of the frequency axis.

The voice cord vibration generating portion 70 generates voice cord vibrations of the synthesized speech in accordance with the fundamental frequency pattern output from the fundamental frequency pattern generating portion 60.

By changing the end of the fundamental frequency pattern generated for each accent phrase, based on the length of the pause between the accent phrase and the succeeding accent phrase, the accent phrases are smoothly connected, so that natural sentence speech can be realized.

In the above description, in the first, the third and the fourth embodiments, the straight line is used as the interpolation function, and in the second embodiment, the critical damping quadratic linear system on the logarithmic frequency axis is used as the interpolation function. However, the critical damping quadratic linear system may be used in the first, the third and the fourth embodiments, and the straight line may be used in the second embodiment. Other functions on the real time axis may be similarly employed.

In the second embodiment, the fundamental frequency from the head of the accent phrase to the rise reference point is interpolated by use of the critical damping quadratic linear system on the logarithmic frequency axis, and in the fourth embodiment, the fundamental frequency is interpolated by applying the fundamental frequency pattern plotted on the real time axis. However, the fundamental frequency pattern plotted on the real time axis may be applied in the second embodiment, and the critical damping quadratic linear system on the logarithmic frequency axis may be used in the fourth embodiment.

In the second embodiment, the time length of the vowel portion of each mora is divided into four equal sections and the typical value of the fundamental frequency of each section is stored in the vowel time length standardized fundamental frequency data base 150*a*. However, any data that are a fundamental frequency pattern standardized by the time length of each phoneme may be stored.

In the second and the fifth embodiments, the center of the third section of the four equal sections of the vowel length of the mora concerned is set as the accent rise reference point. However, any value that is a relative position corresponding to the latter half of the vowel may be set as the reference point.

In the fifth embodiment, the time length of the vowel portion of each mora is divided into four equal sections and the typical value of the fundamental frequency of each section is stored in the vowel time length standardized fundamental frequency data base 150*a*. However, any data that are a fundamental frequency pattern standardized by the time length of each vowel may be stored.

In the second and the fifth embodiments, the center of the third section of the four equal sections of the vowel length of the mora concerned is set as the accent rise reference point. However, any value that is a relative position corresponding to the latter half of the vowel may be set as the reference point.

In the second and the fifth embodiments, the following two points are set as the fall reference points: the center of the third section of the four equal sections of the vowel portion of the mora corresponding to the accent nucleus; and the center of the third section of the four equal sections of the vowel length of the mora next to the accent nucleus. However, any values that are relative positions corresponding to the latter half of the vowel may be set as the reference points.

In the second and the fifth embodiments, the center of the second section of the four equal sections of the vowel length of the last mora of the accent phrase is set as the accent phrase end reference point. However, any value that is a relative position corresponding to the first half of the vowel may be set as the reference point.

In the second and the fifth embodiments, the center of the third section of the four equal sections of the vowel length of the last mora of the utterance is set as the word end reference point. However, any value that is a relative position corresponding to the latter half of the vowel may be set as the reference point.

In the fifth embodiment, the fundamental frequency pattern to which the microprosody is added is generated in a similar manner to that of the second embodiment. However, it may be generated in a manner similar to that of the first, the third or the fourth embodiment.

In the sixth embodiment, the fundamental frequency pattern of the accent phrase is generated in a similar manner to that of the second embodiment. However, it may be generated in a similar manner to that of the first, the third or the fourth embodiment.

In the sixth embodiment, interpolation is performed after the reference point of the fundamental frequency pattern is changed in accordance with the variation amount obtained from the data base. However, the fundamental frequency pattern may be changed after interpolation is performed.

In the sixth embodiment, as the fundamental frequency pattern variation amount, the difference between the maximum value and the accent phrase end is compressed to 90% for the first accent phrase. However, the compression rate may be any value that is within a range of 70% to less than 100%.

In the sixth embodiment, as the fundamental frequency pattern variation amount, the maximum value is compressed to 70% for the second accent phrase and the maximum value is compressed to 70% for the third and the n-th accent phrases. However, the compression rate may be any value that is within a range of 50% to 90%.

In the sixth embodiment, as the fundamental frequency pattern variation amount, the difference between the maximum value and the accent phrase end is compressed to 70% for the second accent phrase and the difference between the maximum value and the accent phrase end is compressed to 68% for the third and the n-th accent phrases. However, the compression rate may be any value that is within a range of 50% to 90%.

In the sixth embodiment, as the fundamental frequency pattern variation amount, the maximum value is compressed to 48% for the last accent phrase. However, the compression rate may be any value that is within a range of 30% to 70%.

In the sixth embodiment, as the fundamental frequency pattern variation amount, the difference between the maximum value and the accent phrase end is compressed to 60% for the last accent phrase. However, the compression rate may be any value that is within a range of 40% to 80%.

In the seventh embodiment, the coefficient of i of the expression 1 is −0.1. However, it may be any value that is within a range of −0.05 to −0.4.

In the seventh embodiment, the coefficient of j of the expression 2 is −0.05. However, it may be any value that is within a range of −0.2 to 0.

In the seventh and the eighth embodiments, for the last accent phrase, the maximum value of the fundamental frequency is a value which is 15% lower than the maximum value of the accent phrase immediately before the last accent phrase. However, the maximum value may be any value that is 10% to 40% lower than the maximum value of the accent phrase immediately before the last accent phrase.

The accent phrase end is a value which is 10% lower than the accent phrase end of the accent phrase immediately therebefore. However, it may be a value which is 5% to 40% lower than the accent phrase end of the accent phrase immediately therebefore.

In the eighth embodiment, the coefficient of i of the expression 3 is −0.02. However, it may be any value that is within a range of −0.01 to −0.2.

In the eighth embodiment, the coefficient of j of the expression 4 is −0.01. However, it may be any value that is within a range of −0.01 to −0.1.

In the tenth embodiment, the fundamental frequency pattern obtained from the mora time length standardized fundamental frequency data base 50 is changed in a similar manner to that of the sixth, the seventh or the eighth embodiment. However, the fundamental frequency pattern may be obtained based on the position of the accent phrase from the accent phrase position fundamental frequency data base 450 like in the ninth embodiment.

In the tenth embodiment, when there is no pause between the n-th accent phrase and the n+1-th accent phrase, the fundamental frequency pattern is changed so that the fundamental frequency difference between the vowel portion center of the last mora of the n-th accent phrase and the vowel portion center of the first mora of the n+1-th accent phrase is not more than 40 Hz. However, the fundamental frequency pattern may be changed so that the difference is any value that is within a range of 20 Hz to 60 Hz.

In the tenth embodiment, as the reference for the change of the fundamental frequencies of the accent phrase fall, the accent phrase end and the word end, the duration of the pause between the n-th accent phrase and the n+1-th accent phrase is classified into the following four steps: less than 50 sec; not less than 50 msec and less than 100 msec; not less than 100 msec and less than 150 msec; and not less than 150 msec. However, it may be classified into any number of steps within a range of one to eight steps.

In the tenth embodiment, when the duration of the pause between the n-th accent phrase and the n+1-th accent phrase is not less than 150 msec, the fundamental frequencies of the accent phrase fall, the accent phrase end and the word end are not changed. However, the upper limit of the pause duration for which the change is made may be any value that is within a range of 120 msec to 200 msec.

In the tenth embodiment, as the reference for the change of the fundamental frequencies of the accent phrase fall, the accent phrase end and the word end, the duration of the pause between the n-th accent phrase and the n+1-th accent phrase is classified into four steps and the upper limit of the fundamental frequency difference between the vowel portion center of the last mora of the n-th accent phrase and the vowel portion center of the first mora of the n+1-th accent phrase is set for each step of the pause duration. However, the upper limit may be set by the following first-degree expression for the pause duration t:

$$at+b \text{ (Hz)} \qquad \text{expression 5}$$

Here, $0<a<0.4$ and $20<b<60$.

By realizing the present invention in the form of a program, storing the program in a recording medium capable of recording a program such as a floppy disk, an optical disk, an IC card or a ROM cassette and transporting the recording medium storing the program, the present invention can be readily carried out with another independent computer system.

In the above-described embodiments, a phonological segment of the present invention corresponds mainly to a mora. However, the present invention is not limited thereto; it may be, for example, a syllable. That is, the present invention is not limited to the fundamental frequency data base that stores data for each mora or for each phoneme as described above but a fundamental frequency data base may be used that stores data for each syllable or for each phoneme included in a syllable. In this case, similar effects to those described above are produced. That is, similar effects to those described above are produced even if "mora" is replaced by "syllable" in all of the above-described embodiments.

In the above-described embodiments, the fundamental frequency data base stores the fundamental frequency patterns of the three morae from the end. However, sufficient effects are produced by storing the fundamental frequency patterns of up to the four morae from the end.

As described above, according to the present invention, by applying the fundamental frequency pattern obtained by standardizing the timing and the angle of the rise of the accent phrase and the fall at the accent nucleus by the vowel length of the mora concerned, variation in fundamental frequency in the mora is reproduced in detail and high naturalness is realized, and by performing interpolation on the real time axis to which the pattern in the data base is not applied, the sense of discontinuity in performing control for each mora is removed and the size of the fundamental frequency pattern data base can be reduced. Alternatively, by setting the timing of the rise of the accent phrase and the fall at the accent nucleus on the time axis standardized by the vowel length of the mora concerned, the timing of variation in fundamental frequency in the mora is reproduced in detail, and with respect to the rise and fall angles, by using the function on the real time axis, a smooth fundamental frequency pattern can be obtained in which the rise and the fall are stable without being affected by the difference in time length due to the phonological segment, so that the sense of discontinuity in performing control for each mora is removed and high naturalness is realized. Further, by using interpolation, the size of the fundamental frequency pattern data base can be reduced. Thus, effects of the present invention are great in practical use.

As described above, first means is a fundamental frequency pattern generating method in which, to generate a fundamental frequency pattern, a phoneme time length standardized fundamental frequency data base is used that stores a fundamental frequency pattern standardized by the phoneme time length of the mora concerned for each mora position in an accent phrase; a fundamental frequency pattern in each mora is set with reference to the data base for each of the mora including the maximum value of the fundamental frequency of the accent phrase, the mora of the accent nucleus and the mora next to the accent nucleus, and one or a plurality of morae at the end of the accent phrase; and the interval between fundamental frequencies set from the data base is interpolated by a function on the real time axis for a section of which fundamental frequency is not set from the data base.

Second means is a fundamental frequency pattern generating method in which, to generate a fundamental frequency pattern, a phoneme time length standardized fundamental frequency data base is used that stores a fundamental frequency pattern standardized by the phoneme time length of the mora concerned for each mora position in an accent phrase; a rise reference point providing the maximum value of the fundamental frequency of the accent phrase, a fall reference point providing the accent fall, an accent phrase end reference point providing the fundamental frequency at the end of the accent phrase and a word end reference point providing the fundamental frequency at the end of the utterance are set at time points of fixed ratios to the vowel length of the mora concerned; a fundamental frequency is set for each of the reference points with reference to the data base; and interpolation by a function on the real time axis is performed for the fundamental frequency between each two of the reference points.

Third means is a fundamental frequency pattern generating method in which, to generate a fundamental frequency pattern, a phoneme time length standardized fundamental frequency data base is used that stores a fundamental frequency pattern standardized by the time length of the vowel or the vowel corresponding portion of the mora concerned; a fundamental frequency pattern in each mora is set with reference to the data base for each of the mora including the maximum value of the fundamental frequency of the accent phrase, the mora of the accent nucleus and the mora next to the accent nucleus, and one or a plurality of morae at the end of the accent phrase; and the interval between fundamental frequencies set from the data base is interpolated by a function on the real time axis for a section of which fundamental frequency is not set from the data base.

Fourth means is a fundamental frequency pattern generating method in which, to generate a fundamental frequency pattern, a phoneme time length standardized fundamental frequency data base is used that stores a fundamental frequency pattern standardized by the time length of the vowel or the vowel corresponding portion of the mora concerned; a rise reference point providing the maximum value of the fundamental frequency of the accent phrase, a fall reference point providing the accent fall, an accent phrase end reference point providing the fundamental frequency at the end of the accent phrase and a word end reference point providing the fundamental frequency at the end of the utterance are set at time points of fixed ratios to the vowel length of the mora concerned; a fundamental frequency is set for each of the. reference points with reference to the data base; and interpolation by a function on the real time axis is performed for the fundamental frequency between each two of the reference points.

Fifth means is a fundamental frequency pattern generating method in which, to generate a fundamental frequency pattern, the following data bases are used: a phoneme time length standardized fundamental frequency data base that stores a fundamental frequency pattern standardized by the phoneme time length of the mora concerned for each mora position in an accent phrase; and a microprosody data base that stores the difference between a value obtained by standardizing the fundamental frequency of each phoneme or each phonological segment string by the phoneme time length, and the fundamental frequency pattern, and the microprosody data are added to or subtracted from the fundamental frequency pattern obtained from the phoneme time length standardized fundamental frequency data base.

Sixth means is a fundamental frequency generating method for generating a fundamental frequency pattern for each accent phrase by use of a phoneme time length standardized fundamental frequency data base that stores a fundamental frequency pattern standardized by the phoneme time length of the mora concerned for each mora position in an accent phrase. In this method, when the fundamental frequency pattern corresponding to the number of morae and the accent type of the accent phrase for which the fundamental frequency is to be generated is not stored in the phoneme time length standardized fundamental frequency data base, using the fundamental frequency pattern in the data base, where the accent phrase for which the fundamental frequency is to be generated is of n-mora m type, the fundamental frequency pattern obtained from the data base is of l-mora j type, the position of the mora including the maximum value of the obtained fundamental frequency pattern is i and the number of morae at the accent phrase end of the obtained fundamental frequency pattern is k, when $m \leqq i+1$, the first to the j+1-th morae of the fundamental frequency pattern obtained from the data base are applied to the first to the m+1-th morae, the l-k+1-th to the l-th morae of the fundamental frequency pattern obtained from the data base are applied to the n−k+1-th to the n-th morae, and interpolation on the real time axis is performed for the morae therebetween, thereby generating a fundamental frequency pattern. When $i+1<m \leqq n-k+1$, the first to the i-th morae of the fundamental frequency pattern obtained from the data base are applied to the first to the i-th morae, the j-th and the j+1-th morae of the fundamental frequency pattern obtained from the data base are applied to the m-th and the m+1-th data base, the l−k+1-th to the l-th morae of the fundamental frequency pattern obtained from the data base are applied to the n−k+1-th to the n-th morae, and interpolation on the real time axis is performed for the morae therebetween, thereby generating a fundamental frequency pattern. When $m>n-k+1$, the first to the i-th morae of the fundamental frequency pattern obtained from the data base are applied to the first to the i-th morae, the j-th to the l-th morae of the fundamental frequency pattern obtained from the data base are applied to the m-th to the n-th morae, and interpolation on the real time axis is performed for the morae therebetween, thereby generating a fundamental frequency pattern.

Seventh means is a fundamental frequency generating method for generating a fundamental frequency pattern by use of a fundamental frequency data base in which the fundamental frequency pattern of the accent phrase is classified according to the position of the accent phrase in the sentence phrase and whether the accent phrase is situated at the end of the sentence or not.

Eighth means is a fundamental frequency pattern generating method in which the following data bases are used: a fundamental frequency data base that stores the fundamental frequency of the accent phrase; and a variation data base that stores the variation amount of the fundamental frequency pattern according to the position of the accent phrase in the sentence phrase and whether the accent phrase is situated at the end of the sentence or not, and the fundamental frequency pattern obtained from the fundamental frequency data base is changed in accordance with the variation amount obtained from the variation data base, thereby generating a fundamental frequency pattern.

Ninth means is a fundamental frequency pattern generating method in which a fundamental frequency data base that stores the fundamental frequency pattern of the accent phrase is used, and the fundamental frequency pattern obtained from the fundamental frequency data base is changed by a function of the position i of the accent phrase in the sentence phrase.

Tenth means is a fundamental frequency pattern generating method in which a fundamental frequency data base that stores the fundamental frequency pattern of the accent phrase is used, and the fundamental frequency pattern obtained from the fundamental frequency data base is changed, for a mora serving as the reference for deciding the fundamental frequency pattern, by a function of the position j of the reference mora in the sentence phrase.

Eleventh means is a fundamental frequency generating method in which a fundamental frequency pattern is generated for each accent phrase, and characteristics, namely, the accent fall, the accent end and the end point of the accent phrase concerned are changed so that the difference between the frequencies of the accent end and the end point of the accent phrase concerned and the start point of the next accent phrase is not more than a predetermined value.

What is claimed is:

1. A method for generating fundamental frequencies of an accent phrase having a time length, comprising the steps of:

(a) generating and storing a fundamental frequency for each of a plurality of individual phonological segments in a data base;

(b) dividing an accent phrase into a sequence of phonological segments, each phonological segment occurring in a portion of the time length;

(c) locating at least one of (1) a first phonological segment occurring in a first portion of the time length and a last phonological segment occurring in a last portion of the time length; (2) a phonological segment having a maximum fundamental frequency in a portion of the time length; (3) a phonological segment having an accent nucleus in a portion of the time length; and (4) a phonological segment positioned adjacent the phonological segment having the accent nucleus;

(d) obtaining from the data base a fundamental frequency for at least one phonological segment located in step (c); and (e) interpolating a fundamental frequency for other phonological segments in the accent phrase based on the respective fundamental frequency obtained in step (d).

2. A method according to claim 1, wherein said fundamental frequency pattern is extracted from naturally uttered speech.

3. A method according to claim 1, wherein said fundamental frequency obtained from the data base is classified according to at least one of a plurality of the following: the number of morae; the number of syllables; an accent position; a phonological segment; and a phoneme string.

4. A method according to claim 1, wherein said interpolating step is performed by linear interpolation on a real time axis.

5. A method according to claim 1, wherein said interpolating step uses an interpolation function that is linear on the real time axis and logarithmic on a frequency axis.

6. The method of claim 1 wherein the phonological segment is a mora.

7. The method of claim 1 wherein the phonological segment is a phoneme.

8. A fundamental frequency pattern generating method according to claim 1, wherein said phonological segment is a mora or a syllable.

9. A program recording medium in which a program is recorded for executing all or part of steps of the fundamental frequency pattern generating method according to claim 1.

10. A fundamental frequency pattern generating method for generating a fundamental frequency of an accent phrase, wherein all or part of a rise reference point of the accent phrase for which the fundamental frequency is to be generated, a fall reference point generating an accent, an accent phrase end reference point deciding fundamental frequency patterns of a plurality of phonological segments including any of one phonological segment at an end of the accent phrase, and a word end reference point generating a fundamental frequency pattern of a word end are set on a time axis standardized by a time length of a phoneme included in each phonological segment, wherein a fundamental frequency data base is referred to that stores, of fundamental frequencies extracted from fundamental frequency patterns obtained by standardizing the fundamental frequency patterns of the phonemes included in the phonological segments by time lengths of the phonemes, a fundamental frequency pattern of at least one of the rise reference point of the accent phrase, the fall reference point, the accent phrase end reference point and the word end reference point, wherein a fundamental frequency at the set reference point is set with reference to the fundamental frequency data base, and wherein a fundamental frequency between the reference points which fundamental frequency has not been set in a stage of the fundamental frequency setting is interpolated by a function on a real time axis or by a fundamental frequency pattern plotted on the real time axis.

11. A fundamental frequency pattern generating method according to claim 10, wherein said fundamental frequency pattern is extracted from naturally uttered speech.

12. A fundamental frequency pattern generating method according to claim 10, wherein said fundamental frequency pattern stored in the fundamental frequency data base is classified according to one or a plurality of the following standards: the number of morae; the number of syllables; an accent position; a phonological segment; and a phoneme string.

13. A fundamental frequency pattern generating method according to claim 10, wherein said interpolation on the real time axis is linear interpolation.

14. A fundamental frequency pattern generating method according to claim 10, wherein an interpolation function for performing the interpolation on the real time axis is a critical damping quadratic linear system on a logarithmic frequency axis.

15. A fundamental frequency pattern generating method according to claim 10, wherein a fundamental frequency from a head to the rise reference point of the accent phrase is interpolated by a fundamental frequency pattern plotted on the real time axis.

16. A fundamental frequency pattern generating method according to claim 10, wherein said rise reference point of the accent phrase is located at a point within the latter half of the vowel length of the phonological segment concerned.

17. A fundamental frequency pattern generating method according to claim 10, wherein said fall reference point is located at a point within the latter half of the vowel length of the phonological segment concerned.

18. A fundamental frequency pattern generating method according to claim 10, wherein said accent phrase end reference point is located at a point within the first half of the vowel length of the phonological segment concerned.

19. A fundamental frequency pattern generating method according to claim 10, wherein a last uttered phonological segment reference point is located at a point within the latter half of the vowel length of the phonological segment concerned.

20. A fundamental frequency pattern generating method for generating a fundamental frequency of an accent phrase, wherein a fundamental frequency data base is referred to that stores a fundamental frequency pattern obtained by standardizing a fundamental frequency pattern corresponding to a vowel portion included in at least one of the following phonological segments by a time length of the vowel included in the phonological segment: a first phonological segment of the accent phrase; a phonological segment where the fundamental frequency takes a maximum value; a phonological segment of an accent nucleus and a phonological segment next to the accent nucleus; and one phonological segment at an end or a plurality of phonological segments which are four or less phonological segments from the end, wherein in all or part of the following phonological segments: the first phonological segment of the accent phrase for which the fundamental frequency is to be generated; the phonological segment where the fundamental frequency is the maximum value in the accent phrase; the phonological segment of the accent nucleus and the phonological segment next to the accent nucleus in the accent phrase; and the phonological segment of the end of the accent phrase, a fundamental frequency pattern for each vowel included in the phonological segments is set, and wherein a fundamental frequency between the phonological segments for which the fundamental frequency pattern setting is not performed is interpolated by a function on a real time axis.

21. A fundamental frequency pattern generating method according to claim 20, wherein when the vowel included in the phonological segment is a monophthong syllable, a fundamental frequency pattern obtained with reference to the fundamental frequency data base is applied to a latter half of the monophthong syllable.

22. A fundamental frequency pattern generating method according to claim 21, wherein when the first phonological segment of the accent phrase for which the fundamental frequency is to be generated is a monophthong syllable, a fundamental frequency of a head of the first phonological segment is set by use of a fundamental frequency of a head of an accent phrase stored in the fundamental frequency data base, and wherein an interval between the set fundamental frequency of the head of the first phonological segment and the latter half of the syllable is interpolated by the function on the real time axis.

23. A fundamental frequency pattern generating method according to claim 21, wherein a syllabic nasal and a long vowel included in the phonological segment are treated in a manner similar to the manner in which the monophthong syllable is treated.

24. A fundamental frequency pattern generating method according to claim 20, wherein said fundamental frequency pattern is extracted from naturally uttered speech.

25. A fundamental frequency pattern generating method according to claim 20, wherein said fundamental frequency pattern stored in the fundamental frequency data base is classified according to one or a plurality of the following standards: the number of morae; the number of syllables; an accent position; a phonological segment; and a phoneme string.

26. A fundamental frequency pattern generating method according to claim 20, wherein said interpolation on the real time axis is linear interpolation.

27. A fundamental frequency pattern generating method according to claim 20, wherein an interpolation function for performing the interpolation on the real time axis is a critical damping quadratic linear system on a logarithmic frequency axis.

28. A fundamental frequency pattern generating method for generating a fundamental frequency of an accent phrase, wherein all or part of a rise reference point of the accent phrase for which the fundamental frequency is to be generated, a fall reference point generating an accent, an accent phrase end reference point deciding a fundamental frequency pattern of an end of the accent phrase, and a word end reference point generating a fundamental frequency pattern of a word end are located on a time axis standardized by a time length of a phoneme included in each phonological segment, wherein a fundamental frequency data base is referred to that stores, of fundamental frequencies extracted from fundamental frequency patterns obtained by standardizing fundamental frequency patterns of vowels included in the phonological segments by time lengths of the vowels, a fundamental frequency of at least one of the rise reference point of the accent phrase, the fall reference point, the accent phrase end reference point and the word end reference point, wherein a fundamental frequency corresponding to the located time axis is determined by reference to the fundamental frequency data base, and wherein a fundamental frequency between the reference points for which the fundamental frequency is not determined from the fundamental frequency data base is interpolated by a function plotted on a real time axis or by a fundamental frequency pattern plotted on the real time axis.

29. A fundamental frequency pattern generating method according to claim 28, wherein said fundamental frequency pattern is extracted from naturally uttered speech.

30. A fundamental frequency pattern generating method according to claim 28, wherein said fundamental frequency pattern is classified according to one or a plurality of the following standards: the number of morae; the number of syllables; an accent position; a phonological segment; and a phoneme string.

31. A fundamental frequency pattern generating method according to claim 28, wherein said interpolation on the real time axis is linear interpolation.

32. A fundamental frequency pattern generating method according to claim 28, wherein an interpolation function for performing the interpolation on the real time axis is a critical damping quadratic linear system on a logarithmic frequency axis.

33. A fundamental frequency pattern generating method according to claim 28, wherein a fundamental frequency from a head to the rise reference point of the accent phrase is interpolated by a fundamental frequency pattern plotted on the real time axis.

34. A fundamental frequency pattern generating method according to claim 28, wherein said rise reference point of the accent phrase is located at a time point within the latter half of the vowel length of the phonological segment concerned.

35. A fundamental frequency pattern generating method according to claim 34, wherein when a first phonological segment of the accent phrase for which the fundamental frequency is to be generated is a monophthong syllable, a fundamental frequency of a head of the first phonological segment is set by use of a fundamental frequency of a head of an accent phrase stored in the fundamental frequency data base, and an interval between the fundamental frequency of the head of the first phonological segment and the time point of the predetermined ratio is interpolated by the function on the real time axis.

36. A fundamental frequency pattern generating method according to claim 35, wherein a syllabic nasal and a long vowel included in the phonological segment are treated in a manner similar to the manner in which the monophthong syllable is treated.

37. A fundamental frequency pattern generating method according to claim 34, wherein when the phonological segment for which the fundamental frequency is to be generated is a monophthong syllable, said time point is located within the latter ¼ of the time length of the phonological segment concerned.

38. A fundamental frequency pattern generating method according to claim 37, wherein a syllabic nasal and a long vowel included in the phonological segment are treated in a manner similar to the manner in which the monophthong syllable is treated.

39. A fundamental frequency pattern generating method according to claim 28, wherein said fall reference point is located at a time point within the latter half of the vowel length of the phonological segment concerned.

40. A fundamental frequency pattern generating method according to claim 39, wherein when the phonological segment for which the fundamental frequency is to be generated is a monophthong syllable, said time point is located within the latter ¼ of the time length of the phonological segment concerned.

41. A fundamental frequency pattern generating method according to claim 40, wherein a syllabic nasal and a long vowel included in the phonological segment are treated in a manner similar to the manner in which the monophthong syllable is treated.

42. A fundamental frequency pattern generating method according to claim 28, wherein said accent word end reference point is a time point of a predetermined ratio of up to ½ the vowel length of the phonological segment concerned.

43. A fundamental frequency pattern generating method according to claim 28, wherein an utterance last phonological segment reference point is a time point of a predetermined ratio of ½ to 1 the vowel length of the phonological segment concerned.

44. A fundamental frequency pattern generating method according to claim 43, wherein when the phonological segment for which the fundamental frequency is to be generated is a monophthong syllable, said predetermined ratio is a time point of a predetermined ratio of ¾ to 1 the time length of the phonological segment concerned.

45. A fundamental frequency pattern generating method according to claim 44, wherein when one of a syllabic nasal and a long vowel is included in the phonological segment, said one includes a fundamental frequency generated based on a time point located within the latter ¼ of the phonological segment concerned.

46. A fundamental frequency pattern generating method for generating a fundamental frequency of an accent phrase, wherein a fundamental frequency pattern of each accent phrase is set with reference to a fundamental frequency data base that stores a fundamental frequency pattern standardized by a time length of each phoneme included in a phonological segment classified according to one or both of the number of phonological segments and an accent position, and wherein a value corresponding to a phoneme or a phonological segment string for which the fundamental frequency is to be generated is obtained from a microprosody data base that stores a difference between a fundamental frequency of each phonological segment or each phoneme string standardized by a time length of the phoneme and said fundamental frequency pattern which difference is classified according to a phonological segment or a phoneme string, and the corresponding value is added to the set fundamental frequency or subtracted from the set fundamental frequency to thereby generate the fundamental frequency of the accent phrase.

47. A fundamental frequency pattern generating method according to claim 46, wherein said fundamental frequency pattern is extracted from naturally uttered speech.

48. A fundamental frequency pattern generating method according to claim 46, wherein a fundamental frequency pattern which has not been set in a stage of the setting performed with reference to the fundamental frequency data base is interpolated by a function on a real time axis, and wherein said interpolation on the real time axis is linear interpolation.

49. A fundamental frequency pattern generating method according to claim 46, wherein a fundamental frequency pattern which has not been set in a stage of the setting performed with reference to the fundamental frequency data base is interpolated by a function on a real time axis, and wherein said interpolation function on the real time axis is a critical damping quadratic linear system on a logarithmic frequency axis.

50. A fundamental frequency pattern generating method according to claim 46, wherein said microprosody data base stores the difference between the frequency stored in the fundamental frequency database and a frequency of a synthesis unit used for speech synthesis.

51. A fundamental frequency pattern generating method for generating a fundamental frequency pattern of an accent phrase by use of a fundamental frequency data base storing a fundamental frequency pattern classified according to the number of phonological segments and an accent position, wherein when a fundamental frequency pattern corresponding to the number of phonological segments and an accent pattern of the accent phrase for which the fundamental frequency pattern is to be generated is not stored in the fundamental frequency data base and an accent position of the accent phrase for which the fundamental frequency is to be generated is at or before a phonological segment position next to a phonological segment position including a peak of the fundamental frequency stored in the fundamental frequency data base, (1) the fundamental frequency pattern stored in the fundamental frequency data base is used which as an accent position the same as the accent position of the accent phrase for which the fundamental frequency pattern is to be generated, said fundamental frequency pattern stored in the fundamental frequency data base corresponding to the number of phonological segments closest to the number of phonological segments of the accent phrase for which the fundamental frequency pattern is to be generated, (2) a fundamental frequency pattern from a first phonological segment to a phonological segment next to an accent nucleus is generated by applying a fundamental frequency from a first phonological segment to a phonological segment next to an accent nucleus of a fundamental frequency pattern stored in the fundamental frequency data base, (3) a fundamental frequency from a second phonological segment from the accent nucleus to a phonological segment immediately before an end of the accent phrase including predetermined four or less number of phonological segments is generated by performing interpolation by (a) fundamental frequencies of the second phonological segment from the accent nucleus and the end of the accent phrase or (b) fundamental frequencies of the phonological segment next to the accent nucleus and the end of the accent phrase or (c) fundamental frequencies of the second phonological segment from the accent nucleus and the phonological segment immediately before the end of the accent phrase or (d) fundamental frequencies of the phonological segment next to the accent nucleus and the phonological segment immediately before the end of accent phrase of the fundamental frequency pattern stored in the fundamental frequency data base, and (4) a fundamental frequency of the end of the accent phrase for which the fundamental frequency pattern is to be generated is generated by applying a fundamental frequency of the end of the accent phrase of the fundamental frequency pattern stored in the fundamental frequency data base.

52. A fundamental frequency pattern generating method according to claim 51, wherein said fundamental frequency pattern is extracted from naturally uttered speech.

53. A fundamental frequency pattern generating method according to claim 51, wherein said interpolation is linear interpolation.

54. A fundamental frequency pattern generating method according to claim 51, wherein a fundamental frequency from a head of the accent phrase to the peak of the fundamental frequency is interpolated by a fundamental frequency pattern plotted on the real time axis.

55. A fundamental frequency pattern generating method for generating a fundamental frequency pattern of an accent phrase by use of a fundamental frequency data base storing a fundamental frequency pattern classified according to the number of phonological segments and an accent position, wherein when a fundamental frequency pattern corresponding to the number of phonological segments and an accent pattern of the accent phrase for which the fundamental frequency pattern is to be generated is not stored in the fundamental frequency data base and an accent position of the accent phrase for which the fundamental frequency pattern is to be generated is after a phonological segment position next to a phonological segment position including a peak of the fundamental frequency stored in the fundamental frequency data base and before an end of the predetermined accent phrase, (1) a fundamental frequency pattern stored in the fundamental frequency data base is used which has an accent nucleus at a second phonological segment from the peak of the fundamental frequency stored in the fundamental frequency data base or at a phonological segment thereafter and before the end of the accent phrase, said fundamental frequency pattern stored in the fundamental frequency data base corresponding to the number of phonological segments closest to the number of the phonological segments of the accent phrase for which the fundamental frequency is to be generated, (2) a fundamental frequency pattern from a first phonological segment of the accent phrase for which the fundamental frequency is to be generated to the phonological segment including the peak of the fundamental frequency is generated by applying a fundamental frequency from a first phonological segment of the fundamental frequency pattern stored in the fundamental frequency data base to the phonological segment including the peak of the fundamental frequency, (3) a fundamental frequency from the phonological segment next to the phonological segment including the peak of the fundamental frequency to a phonological segment immediately before the accent nucleus is generated by performing interpolation by (a) fundamental frequencies of the phonological segment including the peak of the fundamental frequency and a phonological segment including the accent nucleus or (b) fundamental frequencies of the phonological segment including the peak of the fundamental frequency and the fundamental frequency immediately before the phonological segment including the accent nucleus or (c) fundamental frequencies of the phonological segment next to the phonological segment including the peak of the fundamental frequency and the phonological segment including the accent nucleus or (d) fundamental frequencies of the phonological segment next to the phonological segment including the peak of the fundamental frequency and the phonological segment immediately before the phonological segment including the accent nucleus of the fundamental frequency pattern stored in the fundamental frequency data base, (4) fundamental frequencies of the phonological segment including the accent nucleus of the accent phrase for which the fundamental frequency is to be generated and a phonological segment immediately thereafter are generated by applying fundamental frequencies of the phonological segment including the accent nucleus and a phonological segment immediately thereafter of the fundamental frequency pattern stored in the fundamental frequency data base, (5) a fundamental frequency from a second phonological segment from the accent nucleus to a phonological segment immediately before an end of the accent phrase including predetermined four or less number of phonological segments is generated by performing interpolation by (a) fundamental frequencies of the second phonological segment from the accent nucleus and the end of the accent phrase or (b) fundamental frequencies of the phonological segment next to the accent nucleus and the end of the accent phrase or (c) fundamental frequencies of the second phonological segment from the accent nucleus and the phonological segment immediately before the end of the accent phrase or (d) fundamental frequencies of the phonological segment next to the accent nucleus and the phonological segment immediately before the end of the accent phrase of the fundamental frequency pattern stored in the fundamental frequency data base, and (6) a fundamental frequency pattern of the end of the accent phrase for which the fundamental frequency is to be generated is generated by applying a fundamental frequency of the phonological segment of the end of the accent phrase of the fundamental frequency pattern stored in the fundamental frequency data base.

56. A fundamental frequency pattern generating method according to claim 55, wherein said fundamental frequency pattern is extracted from naturally uttered speech.

57. A fundamental frequency pattern generating method according to claim 55, wherein said interpolation is linear interpolation.

58. A fundamental frequency pattern generating method according to claim 55, wherein a fundamental frequency from a head of the accent phrase to the peak of the fundamental frequency is interpolated by a fundamental frequency pattern plotted on the real time axis.

59. A fundamental frequency pattern generating method for generating a fundamental frequency pattern of an accent phrase by use of a fundamental frequency data base storing a fundamental frequency pattern classified according to the number of phonological segments and an accent position, wherein when a fundamental frequency pattern corresponding to the number of phonological segments and an accent pattern of the accent phrase for which the fundamental frequency pattern is to be generated is not stored in the fundamental frequency data base and an accent position of the accent phrase for which the fundamental frequency is to be generated is included in a phonological segment of an end of the accent phrase, (1) the fundamental frequency pattern stored in the fundamental frequency data base is used in which the accent position in the end of the accent phrase of the accent phrase for which the fundamental frequency is to be generated and the accent position in the end of the accent phrase are the same, said fundamental frequency pattern stored in the fundamental frequency data base corresponding to the number of phonological segments closest to the number of phonological segments of the accent phrase for which the fundamental frequency is to be generated, (2) a fundamental frequency pattern from a first phonological segment of the accent phrase for which the fundamental frequency is to be generated to a phonological segment including a peak of the fundamental frequency is generated by applying a fundamental frequency from a first phonological segment of the fundamental frequency pattern stored in the fundamental frequency data base to a phonological segment including a peak of the fundamental frequency, (3) a fundamental frequency from a phonological segment next to the phonological segment including the peak of the fundamental frequency to a phonological segment immediately before an accent nucleus is generated by performing interpolation by (a) fundamental frequencies of the phonological segment including the peak of the fundamental frequency and a phonological segment including the accent nucleus or (b) fundamental frequencies of the phonological segment including the peak of the fundamental frequency and the phonological segment immediately before the phonological segment including the accent nucleus or (c) fundamental frequencies of a phonological segment next to the phonological segment including the peak of the fundamental frequency and the phonological segment including the accent nucleus or (d) fundamental frequencies of the phonological segment next to the phonological segment including the peak of the fundamental frequency and the phonological segment immediately before the phonological segment including the accent nucleus of the fundamental frequency pattern stored in the fundamental frequency data base, and (4) a fundamental frequency from a phonological segment including an accent nucleus of the accent phrase for which the fundamental frequency is to be generated to a last phonological segment of the accent phrase is generated by applying a fundamental frequency from the phonological segment including the accent nucleus of the fundamental frequency pattern stored in the fundamental data base to a last phonological segment of the accent phrase.

60. A fundamental frequency pattern generating method according to claim 59, wherein said fundamental frequency pattern is extracted from naturally uttered speech.

61. A fundamental frequency pattern generating method according to claim 59, wherein said interpolation is linear interpolation.

62. A fundamental frequency pattern generating method according to claim 59, wherein a fundamental frequency from a head of the accent phrase to the peak of the fundamental frequency is interpolated by a fundamental frequency pattern plotted on the real time axis.

63. A fundamental frequency pattern generating method for generating a fundamental frequency pattern of an accent phrase by use of a fundamental frequency data base storing a fundamental frequency pattern classified according to the number of phonological segments and an accent position, wherein when a fundamental frequency pattern corresponding to the number of phonological segments and an accent pattern of the accent phrase for which the fundamental frequency pattern is to be generated is not stored in the fundamental frequency data base and an accent type of the accent phrase for which the fundamental frequency is to be generated is a flat type, (1) a fundamental frequency pattern stored in the fundamental frequency data base is used which corresponds to the number of phonological segments closest to the number of phonological segments of the accent phrase of the flat type for which the fundamental frequency is to be generated, (2) a fundamental frequency pattern from a first phonological segment to a phonological segment including a peak of a fundamental frequency is generated by applying a fundamental frequency from a first phonological segment of the fundamental frequency pattern stored in the fundamental frequency data base to a phonological segment including a peak of the fundamental frequency, (3) a fundamental frequency from a phonological segment next to the phonological segment including the peak of the fundamental frequency to a phonological segment of an end of the accent phrase or immediately before a last phonological segment is generated by performing interpolation by (a) fundamental frequencies of the phonological segment including the peak of the fundamental frequency and the end of the accent phrase or the last phonological segment or (b) fundamental frequencies of the phonological segment including the peak of the fundamental frequency and the phonological segment of the end of the accent phrase or immediately before the last phonological segment or (c) fundamental frequencies of the phonological segment next to the phonological segment including the peak of the fundamental frequency and the end of the accent phrase or the last phonological segment or (d) fundamental frequencies of the phonological segment next to the phonological segment including the peak of the fundamental frequency and the phonological segment of the end of the accent phrase or immediately before the last phonological segment of the fundamental frequency pattern stored in the fundamental frequency data base, and (4) a fundamental frequency pattern of an accent phrase end or a last phonological segment of the accent phrase for which the fundamental frequency is to be generated is generated by applying a fundamental frequency of the phonological segment of the end of the accent phrase or the last phonological segment of the fundamental frequency pattern stored in the fundamental frequency data base.

64. A fundamental frequency pattern generating method according to claim 63, wherein said fundamental frequency pattern is extracted from naturally uttered speech.

65. A fundamental frequency pattern generating method according to claim 63, wherein said interpolation is linear interpolation.

66. A fundamental frequency pattern generating method according to claim 63, wherein a fundamental frequency from a head of the accent phrase to the peak of the fundamental frequency is interpolated by a fundamental frequency pattern plotted on the real time axis.

67. A fundamental frequency pattern generating method using a fundamental frequency data base storing a fundamental frequency pattern of an accent phrase, said fundamental frequency pattern being classified according to a position of the accent phrase in a sentence phrase and whether the accent phrase is situated at an end of a sentence or not.

68. A fundamental frequency pattern generating method according to claim 67, wherein in a case where a fundamental frequency pattern corresponding to the classification according to the position, in the sentence phrase, of the accent phrase for which the fundamental frequency pattern is to be generated and whether the accent phrase is situated at the end of the sentence or not is not stored in the fundamental frequency data base, (1) when the accent phrase for which the fundamental frequency pattern is to be generated is a third accent phrase or an accent phrase thereafter in the sentence phrase, a fundamental frequency pattern corresponding to a position the same as the position, in the sentence phrase, of the accent phrase for which the fundamental frequency pattern is to be generated or to a position thereafter and coinciding in the classification according to whether the accent phrase is situated at the end of the sentence or not is applied in the fundamental frequency data base, and (2) when the corresponding fundamental frequency pattern is not stored in the fundamental frequency data base in a position, in the sentence phrase, of the accent phrase for which the fundamental frequency is to be generated or in a position thereafter, a fundamental frequency pattern is generated by applying a fundamental frequency pattern corresponding to a position closest to the position, in the sentence phrase, of the accent phrase for which the fundamental frequency is to be generated and coinciding in the classification according to whether the accent phrase is situated at the end of the sentence or not.

69. A fundamental frequency pattern generating method according to claim 67, wherein said fundamental frequency pattern is extracted from naturally uttered speech.

70. A fundamental frequency pattern generating method according to claim 67, wherein said fundamental frequency pattern stored in the fundamental frequency data base is classified according to one or a plurality of the following standards: the number of morae; the number of syllables; an accent position; a phonological segment; and a phoneme string.

71. A fundamental frequency pattern generating method using a fundamental frequency data base that stores a fundamental frequency pattern of an accent phrase, and using a variation data base that stores a fundamental frequency pattern variation amount for changing one or a plurality of the following characteristics: a start point; a peak; a minimum value; an accent nucleus; an accent fall; an accent phrase end; an end point; and a dynamic range of the fundamental frequency pattern stored in the fundamental frequency data base according to a position, in a sentence phrase, of the accent phrase for which the fundamental frequency is to be generated.

72. A fundamental frequency pattern generating method according to claim 71, wherein when the accent phrase for which the fundamental frequency is to be generated is a first accent phrase in the sentence phrase, the fundamental frequency is generated by applying a corresponding fundamental frequency stored in the fundamental frequency data base, wherein when the accent phrase for which the fundamental frequency is to be generated is a second accent phrase or an accent phrase thereafter in the sentence phrase and is not situated at an end of a sentence, the corresponding fundamental frequency pattern stored in said fundamental frequency data base is compressed on a frequency axis so that a peak of a fundamental frequency of a phonological segment next to an accent nucleus of the first accent phrase and a peak of a fundamental frequency of the second accent phrase or an accent phrase thereafter are equal to each other, and wherein when the accent phrase for which the fundamental frequency is to be generated is the second accent phrase or an accent phrase thereafter in the sentence phrase and is situated at the end of the sentence, the corresponding fundamental frequency pattern stored in the fundamental frequency data base is compressed on the frequency axis so that a value of a frequency of a phonological segment next to an accent nucleus of an accent phrase immediately before the accent phrase for which the fundamental frequency is to be generated and a value of a peak of an accent phrase situated at the end of the sentence are equal to each other.

73. A fundamental frequency pattern generating method according to claim 72, wherein said compression of the fundamental frequency pattern is performed at any compression rate that is within a range of 50% to 90% when there is no accent nucleus in the first accent phrase.

74. A fundamental frequency pattern generating method according to claim 72, wherein said compression of the fundamental frequency pattern is performed at any compression rate that is within a range of 40% to 80% when there is no accent nucleus in an accent phrase immediately before the accent phrase situated at the end of the sentence.

75. A fundamental frequency pattern generating method according to claim 71, wherein when the accent phrase for which the fundamental frequency is to be generated is a first accent phrase in the sentence phrase, the fundamental frequency pattern stored in the fundamental frequency data is not changed, and wherein when the accent phrase for which the fundamental frequency is to be generated is the second accent phrase or an accent phrase thereafter in the sentence phrase, a corresponding fundamental frequency pattern stored in the fundamental frequency data base is compressed on a frequency axis.

76. A fundamental frequency pattern generating method according to claim 75, wherein when the accent phrase for which the fundamental frequency is to be generated is the second accent phrase or an accent phrase thereafter in the sentence phrase, the corresponding fundamental frequency pattern stored in the fundamental frequency data base is compressed so that a peak of a frequency of a phonological segment next to an accent nucleus of the first accent phrase in the sentence phrase to which the accent phrase for which the fundamental frequency is to be generated belongs and a peak of a fundamental frequency of the accent phrase for which the fundamental frequency is to be generated are equal to each other.

77. A fundamental frequency pattern generating method wherein when a fundamental frequency pattern of a sentence phrase formed by connecting a plurality of accent phrases is generated, one or a plurality of the following characteristics:

a start point; a peak; an accent nucleus; an accent fall; an accent phrase end; and an end point of a fundamental frequency pattern stored in a fundamental frequency data base that stores a fundamental frequency pattern of the accent phrase and obtained from the fundamental frequency data base are changed by use of a predetermined rule based on a position of the accent phrase in the sentence phrase.

78. A fundamental frequency pattern generating method according to claim 77, wherein said rule used for changing the peak of the fundamental frequency pattern is such that a peak of a fundamental frequency pattern of a first accent phrase is maintained intact and that peaks of fundamental frequency patterns of other accent phrases take values which are lower by any percentages that is within a range of 5% to 40% than peaks of fundamental frequencies of accent phrases immediately before the accent phrases.

79. A fundamental frequency pattern generating method according to claim 77, wherein when the accent phrase for which the fundamental frequency is to be generated is situated at an end of a sentence, said rule applied to the accent phrase is such that a fundamental frequency of the peak of the accent phrase takes a value which is lower by any percentage that is within a range of 10% to 40% than a fundamental frequency of a peak of an accent phrase immediately before the accent phrase.

80. A fundamental frequency pattern generating method according to claim 77, wherein said rule used for changing the accent phrase end of the fundamental frequency pattern is such that an accent phrase end fundamental frequency of a fundamental frequency pattern of a first accent phrase is maintained intact and that accent phrase end fundamental frequencies of fundamental frequency patterns of other accent phrases take values which are lower by any percentages that is within a range of 5% to 40% than accent phrase end fundamental frequencies of accent phrases immediately before the accent phrases.

81. A fundamental frequency pattern generating method according to claim 80, wherein said rule for changing the accent phrase end is not applied when an accent type of the accent phrase for which the fundamental frequency is to be generated is a flat type.

82. A fundamental frequency pattern generating method according to claim 77, wherein when the accent phrase for which the fundamental frequency is to be generated is situated at an end of a sentence, said rule applied to the accent phrase is such that a fundamental frequency of the end of the accent phrase takes a value which is lower by any percentage that is within a range of 5% to 40% than a fundamental frequency of an end of an accent phrase immediately before the accent phrase.

83. A fundamental frequency pattern generating method wherein when a fundamental frequency pattern of a sentence phrase formed by connecting a plurality of accent phrases is generated, one or a plurality of the following characteristics:

a start point; a peak; an accent nucleus; an accent fall; an accent phrase end; and an end point of a fundamental frequency pattern obtained from a fundamental frequency data base that stores a fundamental frequency pattern of the accent phrase are changed by use of a predetermined rule based on the number of phonological segments from a predetermined position of the sentence phrase to a phonological segment immediately before a phonological segment including the characteristic for which the fundamental frequency is to be generated.

84. A fundamental frequency pattern generating method according to claim 83, wherein said rule used for changing the peak of the fundamental frequency pattern is such that (1-a) a peak of a fundamental frequency from the fundamental frequency data base which fundamental frequency is applied to a first accent phrase in the sentence phrase is maintained intact, that (1-b) as peaks of fundamental frequency patterns of other accent phrases in the sentence phrase, values are used which are obtained by reducing a peak of the first accent phrase based on parameters representative of where phonological segments including the peaks of the other accent phrases in the sentence phrase are from a phonological segment including the peak of the fundamental frequency of the first accent phrase and based on a reduction ratio per phonological segment within a range of 1% to 20%, and that (2) when the fundamental frequency pattern from the fundamental frequency data base is applied to the other accent phrases, the applied fundamental frequency pattern is compressed or expanded on a frequency axis based on a compression rate of the values obtained by the reduction at a corresponding position viewed from the number of phonological segments with respect to a value of the peak of the fundamental frequency pattern from the fundamental frequency data base.

85. A fundamental frequency pattern generating method according to claim 83, wherein when the accent phrase for which the fundamental frequency is to be generated is situated at an end of a sentence, said rule applied to the accent phrase is such that a fundamental frequency of the peak of the accent phrase takes a value which is lower by any percentage that is within a range of 10% to 50% than a fundamental frequency of a peak of an accent phrase immediately before the accent phrase.

86. A fundamental frequency pattern generating method according to claim 83, wherein said rule used when the accent phrase end of the fundamental frequency pattern is changed is such that (1-a) a fundamental frequency of the accent phrase end of the fundamental frequency pattern from the fundamental frequency data base which fundamental frequency is applied to a first accent phrase in the sentence phrase is maintained intact, that (1-b) as accent phrase end fundamental frequencies of fundamental frequency patterns of other accent phrases in the sentence phrase, values are used which are obtained by reducing an end of the first accent phrase based on parameters representative of where phonological segments including the accent phrase ends are from a phonological segment including the peak of the fundamental frequency of the first accent phrase and based on a reduction ratio per phonological segment within a range of 1% to 10%, and that (2) when the fundamental frequency pattern from the fundamental frequency data base is applied to said other accent phrases, the applied fundamental frequency pattern is compressed or expanded on a frequency axis based on a compression rate of a value obtained by the reduction at a corresponding position viewed from the number of phonological segments with respect to a value of the accent phrase end fundamental frequency of the fundamental frequency pattern.

87. A fundamental frequency pattern generating method according to claim 86, wherein said rule for changing the accent phrase end is not applied when an accent type of the accent phrase for which the fundamental frequency is to be generated is a flat type.

88. A fundamental frequency pattern generating method according to claim 83, wherein when the accent phrase for which the fundamental frequency is to be generated is situated at an end of a sentence, said rule applied to the accent phrase is such that a fundamental frequency of the end of the accent phrase takes a value which is lower by any percentage that is within a range of 5% to 40% than a fundamental frequency of an end of an accent phrase immediately before the accent phrase.

89. A fundamental frequency pattern generating method for generating a fundamental frequency pattern for each accent phrase, wherein by changing one or a plurality of the following characteristics: an accent fall; an accent phrase end; and an end point of the accent phrase for which the fundamental frequency pattern is to be generated, a difference between fundamental frequencies of the accent phrase end and the end point of the accent phrase and a fundamental frequency of a start point of an accent phrase next to the accent phrase is not more than a predetermined threshold value.

90. A fundamental frequency pattern generating method according to claim 89, wherein said threshold value is decided by a time length of a pause between the accent phrase and an accent phrase next to the accent phrase.

91. A fundamental frequency pattern generating method according to claim 90, wherein a maximum value of the difference between the fundamental frequencies of the accent phrase end and the end point of the accent phrase and the fundamental frequency of the start point of the accent phrase next to the accent phrase is as follows:

(1) when there is no pause between the accent phrase and the accent phrase next to the accent phrase, the maximum value is a value that is within a range of 20 Hz to 60 Hz; (2) when the pause is not less than a predetermined value that is within a range of 120 msec to 200 msec, for one or a plurality of the following characteristics: the accent fall; the accent phrase end; and the end point, the change is not performed such that the difference between the fundamental frequencies of the accent phrase end and the end point of the accent phrase and the fundamental frequency of the start point of the accent phrase next to the accent phrase is reduced to a value that is the predetermined threshold value or lower; and (3) when the pause is a value that is the predetermined value or lower, for each of sections obtained by dividing a range from 0 msec to the predetermined value into one to eight sections, a predetermined value that is within a range of 20 Hz to 120 Hz is set as the maximum value of the difference between the fundamental frequencies of the accent phrase end and the end point of the accent phrase and the fundamental frequency of the start point of the accent phrase next to the accent phrase.

92. A fundamental frequency pattern generating method according to claim 90, wherein a maximum value of the difference between the the fundamental frequencies of the accent phrase end and the end point of the accent phrase and the fundamental frequency of the start point of the accent phrase next to the accent phrase is a linear function with respect to a duration of the pause betwen the accent phrase and the accent phrase next to the accent phrase.

93. A fundamental frequency pattern generating method according to claim 89, wherein the change of one or a plurality of the following characteristics: the accent fall; the accent phrase end; and the end point is made in a section from a point having a frequency exceeding the threshold value to the accent phrase end for the fundamental frequency of the start point of the accent phrase in the fundamental frequency pattern of the accent phrase.

94. A fundamental frequency pattern generator comprising:

an accent phrase position fundamental frequency data base storing a fundamental frequency pattern of an accent phrase, said fundamental frequency pattern being classified according to a position of the accent phrase in a sentence phrase formed by connecting a plurality of accent phrases, and to whether the accent phrase is situated at an end of a sentence or not; and a fundamental frequency pattern generating portion for setting fundamental frequency patterns of the accent phrases constituting the sentence phrase with reference to the accent phrase position fundamental frequency data base.

95. A fundamental frequency pattern generator according to claim 92, wherein said phonological segment is a mora or a syllable.

96. A fundamental frequency pattern generator for generating a fundamental frequency of an accent phrase comprising:

fundamental frequency data base storing a fundamental frequency pattern obtained by standardizing a fundamental frequency pattern of at least one of the following phonological segments by a time length of the phonological segment: a first phonological segment of the accent phrase; a phonological segment where the fundamental frequency takes a maximum value; a phonological segment of an accent nucleus and a phonological segment next to the accent nucleus; and one phonological segment at an end, or a fundamental frequency pattern obtained by standardizing a fundamental frequency pattern of a phoneme included in at least one of said phonological segments by a time length of the phoneme; and a fundamental frequency pattern generating portion for setting fundamental frequency patterns of all or part of the following phonological segments: the first phonological segment of the accent phrase for which the fundamental frequency is to be generated; the phonological segment where the fundamental frequency takes the maximum value in the accent phrase; the phonological segment of the accent nucleus and the phonological segment next to the accent nucleus in the accent phrase; and the phonological segment of the end of the accent phrase, or a fundamental frequency pattern of each phoneme included in said phonological segments with reference to the fundamental frequency data base, said fundamental frequency pattern generating portion interpolating by a function on a real time axis a fundamental frequency pattern between the phonological segments or between the phonemes which fundamental frequency pattern has not been set in a stage of the fundamental frequency pattern setting.

97. A fundamental frequency pattern generator for generating a fundamental frequency of an accent phrase comprising:

a fundamental frequency data base storing a fundamental frequency pattern standardized by a time length of each phoneme included in a phonological segment classified according to one or both of the number of phonological segments and an accent position;

a microprosody data base storing a difference between a fundamental frequency of each phonological segment or each phoneme string standardized by a time length of the phoneme and the frequency pattern, said difference being classified according to a phonological segment or a phoneme string; and a fundamental frequency pattern generating portion for generating the fundamental frequency of the accent phrase by setting a fundamental frequency pattern of each accent phrase with reference to the fundamental frequency data base, obtaining a value corresponding to a phoneme or a phonological segment string for which the fundamental frequency is to be generated, and adding the corresponding value to the set fundamental frequency or subtracting the corresponding value from the set fundamental frequency.

* * * * *

UNITED STATES PATENT AND TRADEMARK OFFICE

CERTIFICATE OF CORRECTION

PATENT NO. : 6,424,937 B1
DATED : July 23, 2002
INVENTOR(S) : Kato et al.

It is certified that error appears in the above-identified patent and that said Letters Patent is hereby corrected as shown below:

Column 51,
Line 35, “betwen” should read -- between --.
Line 61, “92” should read -- 96 --.

Signed and Sealed this

Twenty-second Day of April, 2003

JAMES E. ROGAN
*Director of the United States Patent and Trademark Office*